US009676570B2

(12) United States Patent
Hubbard, Jr. et al.

(10) Patent No.: US 9,676,570 B2
(45) Date of Patent: Jun. 13, 2017

(54) FEEDER SYSTEM FOR BEVERAGE CONTAINER HOLDER PROCESS

(71) Applicant: LBP Manufacturing LLC, Cicero, IL (US)

(72) Inventors: James A. Hubbard, Jr., Oak Lawn, IL (US); Stephen Alan Smith, Naperville, IL (US); Vicky Elizabeth Dittman, Aurora, IL (US); Frank A. Degliomini, Tinley Park, IL (US); Samuel Angel Valdes, Shorewood, IL (US); Glen Powalish, Saint Charles, IL (US); Mitchell T. Cooper, Plainfield, IL (US)

(73) Assignee: LBP Manufacturing LLC, Cicero, IL (US)

( * ) Notice: Subject to any disclaimer, the term of this patent is extended or adjusted under 35 U.S.C. 154(b) by 0 days.

(21) Appl. No.: 14/796,515

(22) Filed: Jul. 10, 2015

(65) Prior Publication Data

US 2015/0314974 A1 Nov. 5, 2015

Related U.S. Application Data

(63) Continuation of application No. 13/611,820, filed on Sep. 12, 2012, now Pat. No. 9,079,728.

(51) Int. Cl.
*B65H 5/02* (2006.01)
*B65H 3/04* (2006.01)
(Continued)

(52) U.S. Cl.
CPC ..... *B65H 3/042* (2013.01); *B65H 1/06* (2013.01); *B65H 1/20* (2013.01); *B65H 1/30* (2013.01); *B65H 3/045* (2013.01); *B65H 3/063* (2013.01); *B65H 3/0676* (2013.01); *B65H 5/023* (2013.01); *B65H 7/20* (2013.01); *B65H 83/02* (2013.01);
(Continued)

(58) Field of Classification Search
CPC ..... B65H 5/023; B65H 35/10; B65H 2701/12112; B65H 2301/51514; B65H 3/042; B65H 1/06; B65H 3/063; B65H 3/126
USPC ..... 225/4, 106, 100; 220/738; 493/56, 72; 271/3.01, 3.05, 3.06, 201
See application file for complete search history.

(56) References Cited

U.S. PATENT DOCUMENTS 2,276,318 A 3/1942 Lambombarde
2,896,517 A 7/1959 Lambombarde
(Continued)

OTHER PUBLICATIONS

Examination Report issued in related Canadian Application No. 2,826,270 dated Aug. 28, 2015 (3 pages).

*Primary Examiner* — Jeremy R Severson
(74) *Attorney, Agent, or Firm* — Fitch, Even, Tabin & Flannery LLP

(57) ABSTRACT

A system includes a sheet holder configured to hold a sheet of blanks, the sheet of blanks including a first blank and a second blank attached to the first blank. A conveyor mechanism is configured to transport the sheet of blanks from the sheet holder to a separator mechanism. The separator mechanism is configured to apply a pulling force to the first blank. A resistance component is configured to apply a resistance force to the second blank to resist the pulling force. The pulling force and the resistance force are configured to separate the first blank from the second blank.

14 Claims, 24 Drawing Sheets

(51) Int. Cl.

| | |
|---|---|
| ***B65H 1/20*** | (2006.01) |
| ***B65H 7/20*** | (2006.01) |
| ***B65H 83/02*** | (2006.01) |
| ***B65H 1/06*** | (2006.01) |
| ***B65H 1/30*** | (2006.01) |
| ***B65H 3/06*** | (2006.01) |

(52) U.S. Cl.
CPC ..... *B65H 2301/4473* (2013.01); *B65H 2404/623* (2013.01); *B65H 2405/1142* (2013.01); *B65H 2701/176* (2013.01)

(56) References Cited

U.S. PATENT DOCUMENTS

| | | | | | |
|---|---|---|---|---|---|
| 3,771,783 | A | * | 11/1973 | McInerny | B05C 1/04 271/122 |
| 3,785,254 | A | | 1/1974 | Mann | |
| 4,056,046 | A | | 11/1977 | Hughes | |
| 4,144,800 | A | | 3/1979 | Hughes | |
| 4,201,332 | A | | 5/1980 | Wooten | |
| 4,285,680 | A | | 8/1981 | Randles | |
| 4,295,838 | A | | 10/1981 | Richards et al. | |
| 4,397,410 | A | * | 8/1983 | Schueler | 225/98 |
| 4,418,865 | A | | 12/1983 | Bowen | |
| 4,605,464 | A | | 8/1986 | Slevin | |
| 4,614,512 | A | | 9/1986 | Capdeboscq | |
| 4,624,653 | A | | 11/1986 | McBride et al. | |
| 4,636,185 | A | | 1/1987 | Carter et al. | |
| 4,708,708 | A | | 11/1987 | Fries, Jr. | |
| 4,892,223 | A | | 1/1990 | DeMent | |
| 4,897,982 | A | | 2/1990 | Day et al. | |
| 5,062,527 | A | | 11/1991 | Westerman | |
| 5,071,401 | A | | 12/1991 | Bertsch | |
| 5,090,616 | A | | 2/1992 | Bertsch | |
| 5,092,827 | A | | 3/1992 | McAdam, III et al. | |
| 5,095,962 | A | | 3/1992 | Lloyd-Davies et al. | |
| 5,129,641 | A | * | 7/1992 | Long | B65H 3/042 198/460.1 |
| 5,137,506 | A | | 8/1992 | Haenel et al. | |
| 5,158,371 | A | | 10/1992 | Moravek | |
| 5,205,473 | A | | 4/1993 | Coffin, Sr. | |
| 5,238,632 | A | | 8/1993 | Watters et al. | |
| 5,401,013 | A | * | 3/1995 | Hurd | B65H 1/06 271/124 |
| 5,671,861 | A | | 9/1997 | Hall et al. | |
| 5,749,493 | A | | 5/1998 | Boone et al. | |
| 5,785,224 | A | * | 7/1998 | Nowakowski | 225/4 |
| 5,803,346 | A | | 9/1998 | Baker et al. | |
| 5,941,421 | A | | 8/1999 | Overman et al. | |
| 5,993,877 | A | | 11/1999 | Ohtake | |
| 5,997,459 | A | | 12/1999 | Kruger et al. | |
| 6,042,108 | A | * | 3/2000 | Morgan et al. | 271/201 |
| 6,102,252 | A | | 8/2000 | Overman et al. | |
| 6,155,465 | A | | 12/2000 | Steiger | |
| 6,170,715 | B1 | | 1/2001 | Evans | |
| 6,186,361 | B1 | | 2/2001 | Teetsel, III | |
| 6,206,262 | B1 | * | 3/2001 | Achelpohl et al. | 225/100 |
| 6,227,440 | B1 | | 5/2001 | Hart | |
| 6,244,592 | B1 | | 6/2001 | Baba et al. | |
| 6,337,041 | B1 | | 1/2002 | Kuo | |
| 6,419,217 | B1 | * | 7/2002 | Hartmann et al. | 270/52.12 |
| 6,421,984 | B1 | | 7/2002 | Murgatroyd et al. | |
| 6,439,366 | B1 | | 8/2002 | Matkovich | |
| 6,446,845 | B1 | | 9/2002 | Steiger | |
| 6,474,040 | B1 | | 11/2002 | Ours et al. | |
| 6,863,644 | B1 | * | 3/2005 | Cook | 493/141 |
| 7,874,509 | B2 | * | 1/2011 | Kenney | 242/563.2 |
| 9,079,728 | B2 | * | 7/2015 | Hubbard et al. | |
| 2008/0217842 | A1 | * | 9/2008 | Hoffman | B41J 11/0015 271/167 |

* cited by examiner

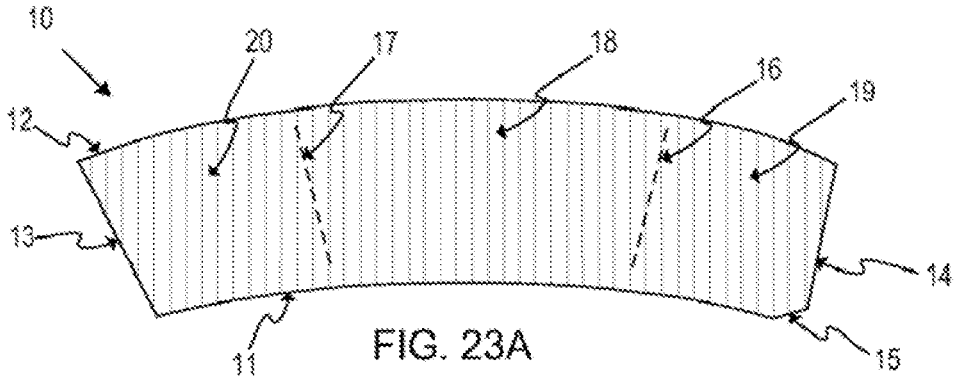
FIG. 23A
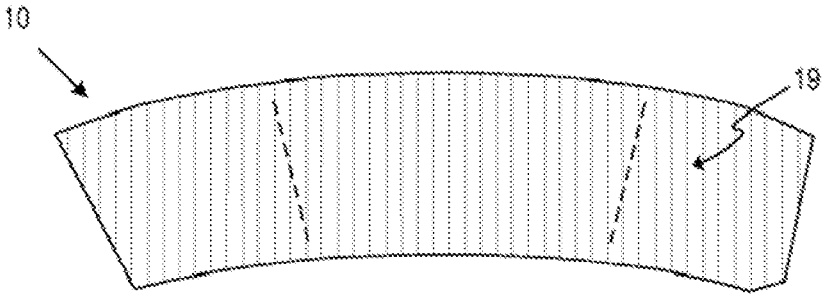
FIG. 23B
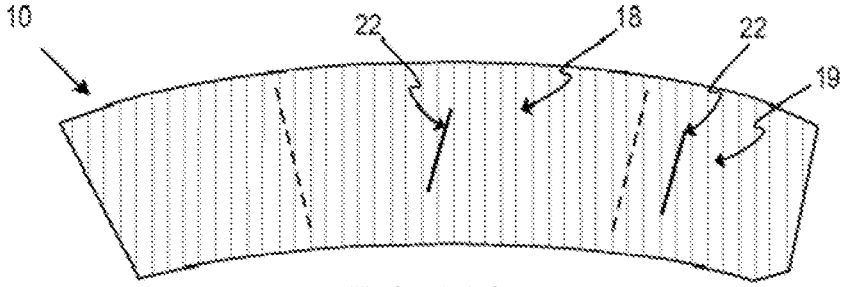
FIG. 23C
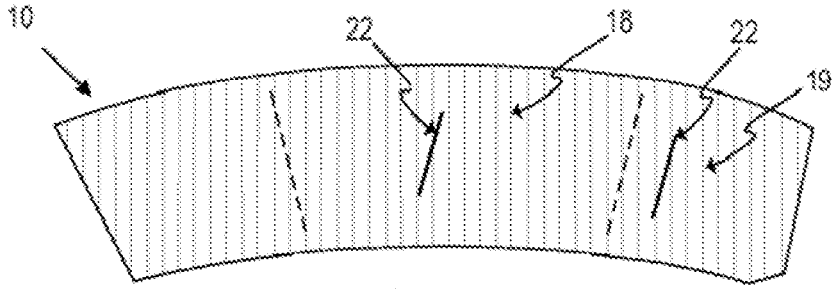
FIG. 23D
Figure 23

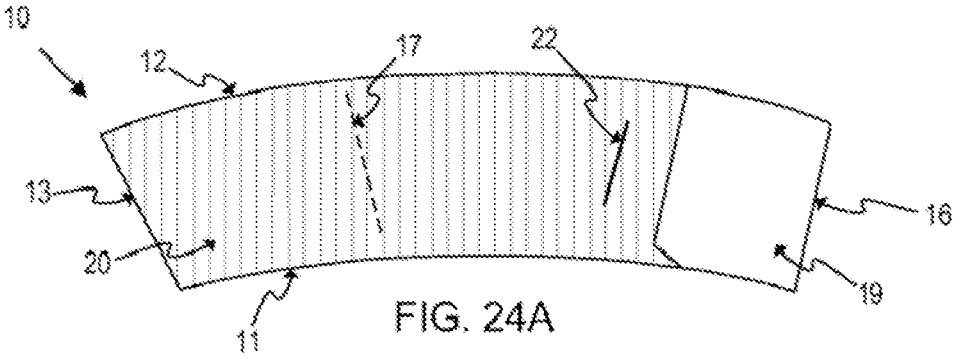
FIG. 24A
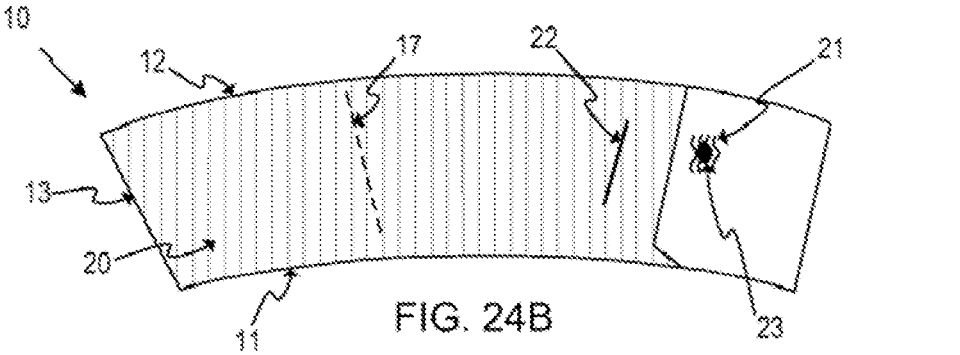
FIG. 24B
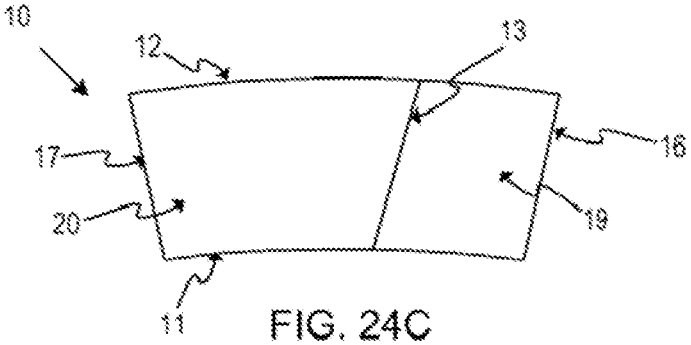
FIG. 24C
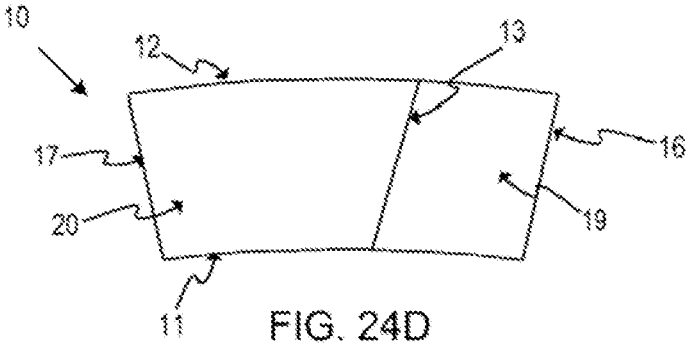
FIG. 24D
Figure 24

FEEDER SYSTEM FOR BEVERAGE CONTAINER HOLDER PROCESS

CROSS-REFERENCE TO RELATED APPLICATIONS

This application is a continuation of U.S. application Ser. No. 13/611,820 (pending) filed Sep. 12, 2012, the disclosure of which is incorporated herein by reference.

FIELD OF APPLICATION

This application relates to beverage container holders and to separating blanks formed into beverage container holders from sheets of material.

BACKGROUND

Beverage container holders can be formed from a variety of materials, for example corrugated, chip board, paper materials, or plastic materials. The beverage container holders can be created in mass production processes that start from individual blanks. The blanks may be taken from larger sheets of material. Removing the blanks from the larger sheets can be done in a rapid and economical manner to minimize the cost of producing the beverage container holders.

SUMMARY OF THE INVENTION

A system includes a sheet holder configured to hold a sheet of blanks, the sheet of blanks including a first blank and a second blank attached to the first blank. A conveyor mechanism is configured to transport the sheet of blanks from the sheet holder to a separator mechanism. The separator mechanism is configured to apply a pulling force to the first blank. A resistance component is configured to apply a resistance force to the second blank to resist the pulling force. The pulling force and the resistance force are configured to separate the first blank from the second blank.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The accompanying drawings are included to provide a further understanding of the claims, are incorporated in, and constitute a part of this specification. The detailed description and illustrated examples described serve to explain the principles defined by the claims.

FIG. 23A is a plan view of an isolated blank as it starts through the processing machine with the corrugated or fluted side up;

FIG. 23B is a plan view of an isolated blank;

FIG. 23C is a plan view of an isolated blank as an adhesive is applied to is fluted surface;

FIG. 23D is a plan view of an isolated blank as air may be applied to the adhesive that was applied to is fluted surface;

FIG. 24A is an isolated plan view of a blank after the glue flap has been folded along one of the folding axes;

FIG. 24B is an isolated plan view of the blank after the left edge has been folded up along a folding axes and glue is being applied to the surface of the linerboard;

FIG. 24C is an isolated plan view of the blank after the right edge has been folded up along a folding axes such that it overlays the portion of the left edge upon which glue has been applied to the surface of the linerboard; and FIG. 24D is an isolated plan view of the blank while pressure is being applied to secure the overlapped portions of the right and left edges together.

DETAILED DESCRIPTION

A feeder system may feed sheets of blanks to a machine that forms beverage container holders. The feeder system can feed the sheets of blanks and automatically detach individual blanks from larger sheets, e.g., in a rapid and economical manner. Additionally or alternatively, the feeder system may be utilized with any process or assembly line that processes individual blanks. The feeder system may improve operation of downstream processes or assembly lines by providing a steady supply of blanks, at a rate determined by the process or assembly line, with reduced operator assistance. Downstream processes and assembly lines may operate at a higher rate, more efficiently, with increased yield, and more consistent results than if the feeder machine was not used.

Figure 1:
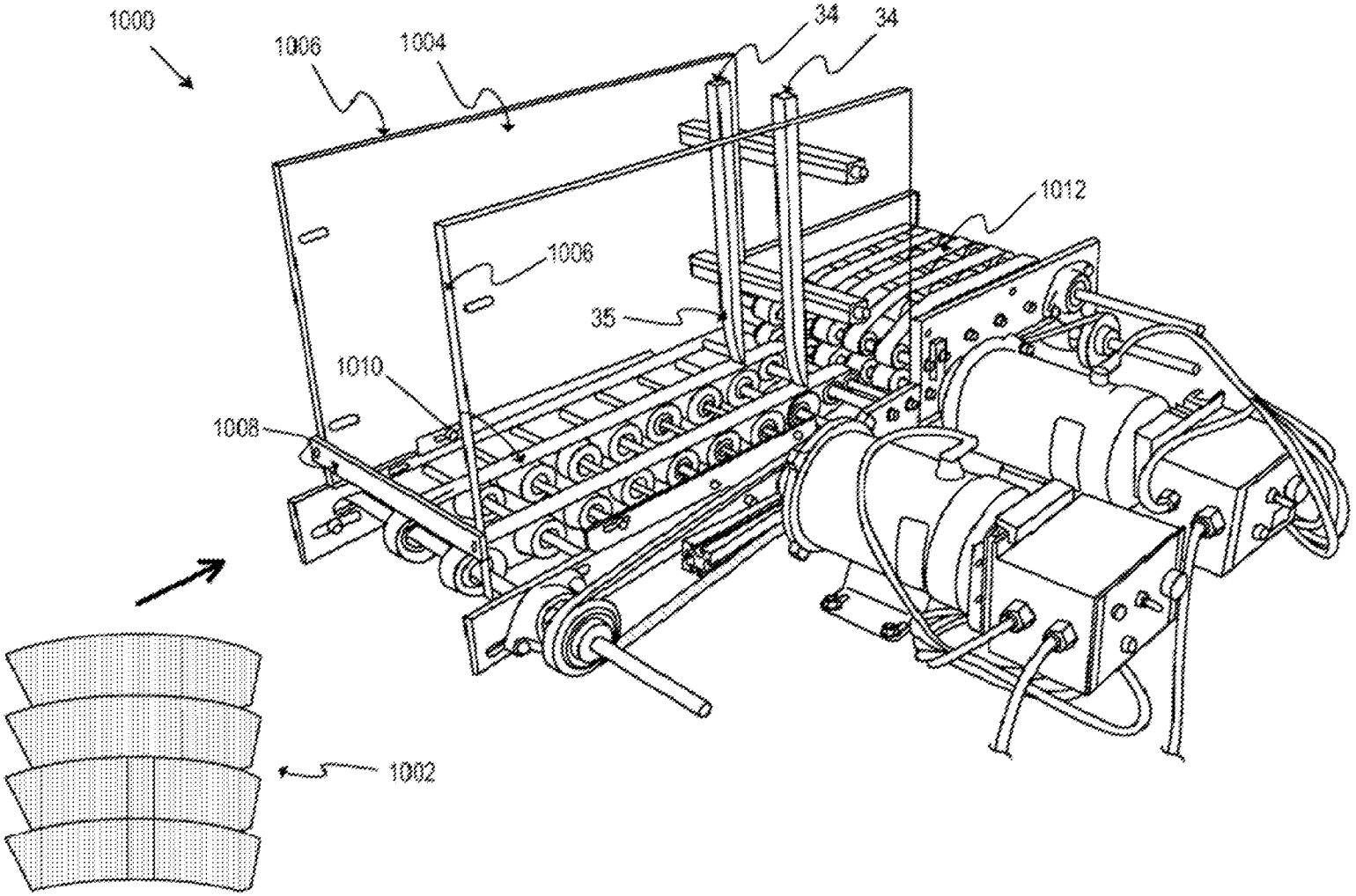
FIG. 1 is a perspective view of an exemplary feeder system.

FIG. 1 is a perspective view of an exemplary feeder system. In FIG. 1, the feeder system 1000 may feed sheets of blanks 1002 that are made up of individual blanks 10. Sheets 1002 may contain two or more blanks 10. It should be noted that sheets 1002 may contain any number of individual blanks. Sheet 1002 in FIG. 1 includes four individual blanks for illustrative purposes. As discussed more thoroughly below, blanks 10 may be composed of any raw material, such as corrugated, chip board, plastic, paper products, and other alternative or recyclable materials. The blanks 10 shown in FIG. 1 may be composed of corrugated, chip board. Alternatively, blanks 10 may not include corrugation. The blanks 10 may be joined together on sheet 1002. The blanks 10 may be joined together along a line, for example a perforated line. The blanks 10 may be joined together by any other mechanisms that allow the blanks 10 to be separated from each other, for example, tearable tabs or nicks. Nicks, as commonly used in the art, may include a line or joining area between blanks in which portions of the joining area have been fully cut through, alternating with portions of the joining area that have not been cut through. The distance between the cut through areas may be any value and may vary depending on properties desired of the nicks. Larger distances between cut through areas may provide a stronger or more resilient joining area, while smaller distances may provide a less strong or less resilient joining area.

Figure 2:
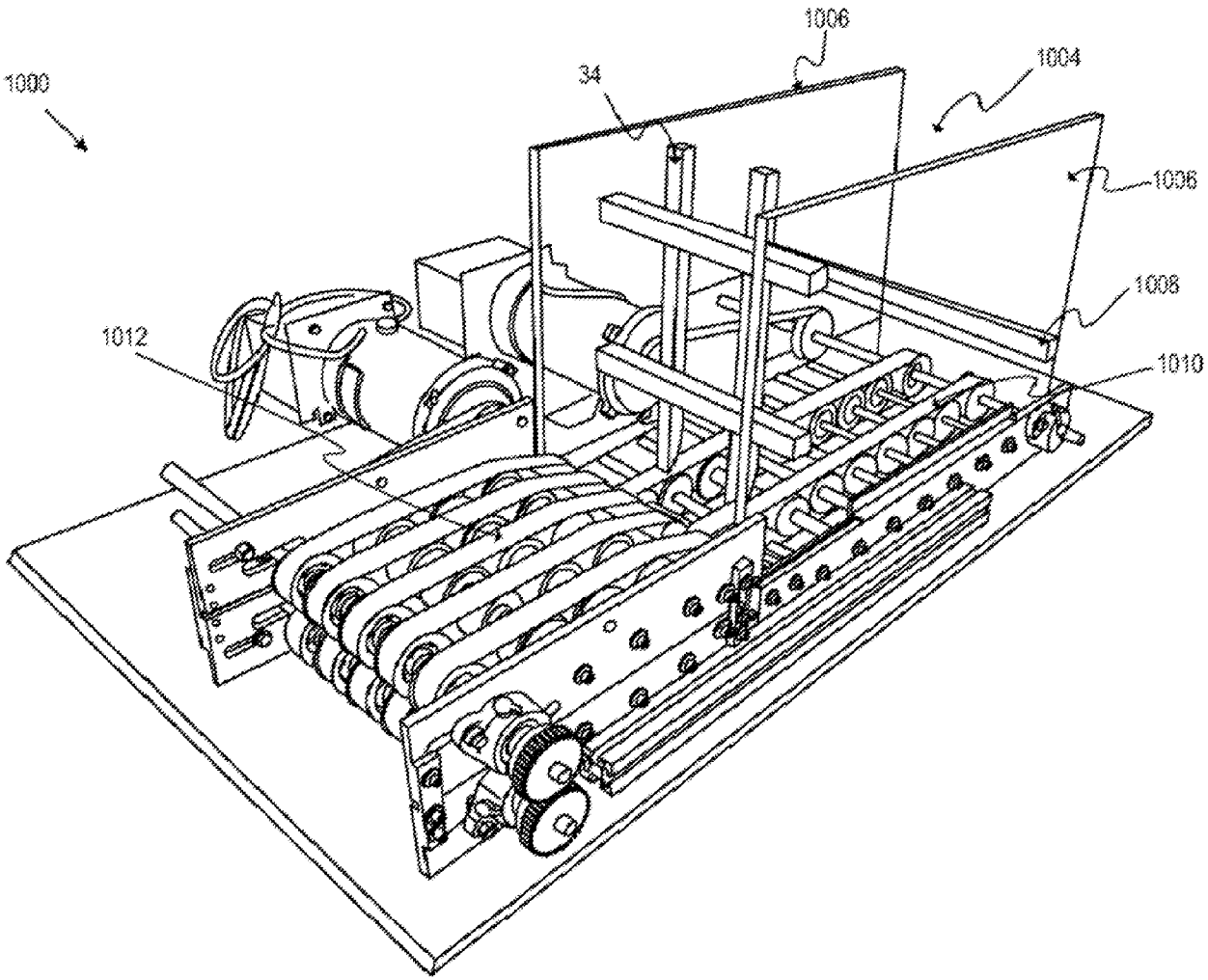
FIG. 2 is another perspective view of the exemplary feeder system.

FIG. 2 is another perspective view of the exemplary feeder system. In FIGS. 1 and 2, a holder 1004 can be used to contain the sheets 1002 prior to separation of the blanks from each other. Sheets 1002 may enter the holder from the top, sides, or back of holder 1004. Holder 1004 may include one or more side panels 1006 and a containment bar 1008 to contain sheets 1002. The side panels 1006 in FIGS. 1 and 2 can be constructed of a transparent material, such as clear plastic or glass. Utilizing transparent material may allow an operator to easily visually inspect sheets 1002 within holder 1004. The side panels 1006 may also be constructed of any material or structure that is capable of containing sheets 1002, such as metal, wood, or opaque plastic. Similarly, containment bar 1008 may be constructed of any material that is capable of containing sheets 1002. Containment bar 1008 may be configured as a long narrow member, e.g., in FIGS. 2 and 3, or containment bar 1008 may be configured as a panel or any other shape capable of containing sheets 1002.

A holder conveyor 1010 may be placed below holder 1004. Holder conveyor 1010 may be constructed of multiple belts and rollers, e.g., in FIGS. 1 and 2, to move sheets 1002. Holder conveyor 1010 may also be constructed of a single belt, with or without rollers, or any other mechanisms to move sheets 1002. Holder conveyor 1010 may be configured to move sheets 1002 forward, as depicted from the left to right in FIG. 1 and from the right to left in FIG. 2. Holder conveyor 1010 may be driven by a series of belts, pulleys, and motors, in FIGS. 1 and 2, or may be driven by any other mechanisms.

Holder 1004 may include feed gate 34 opposite containment bar 1008. Holder 1004 may include two feed gates 34 or may include any other number of feed gates 34. Feed gate 34 may be configured to resist the movement of sheets 1002 as sheets 1002 are moved forward by holder conveyor 1010 to allow a determined number of sheets 1002 to be moved by the conveyor 1010 at a time. The bottom of feed gate 34 may be offset from holder conveyor 1010 to allow the determined number of sheets 1002 to pass beneath feed gate 34 as sheets 1002 are moved forward by holder conveyor 1010. The offset between feed gate 34 and holder conveyor 1010 may be adjusted to allow more or less sheets 1002 to move forward past feed gate 34.

Figure 3:
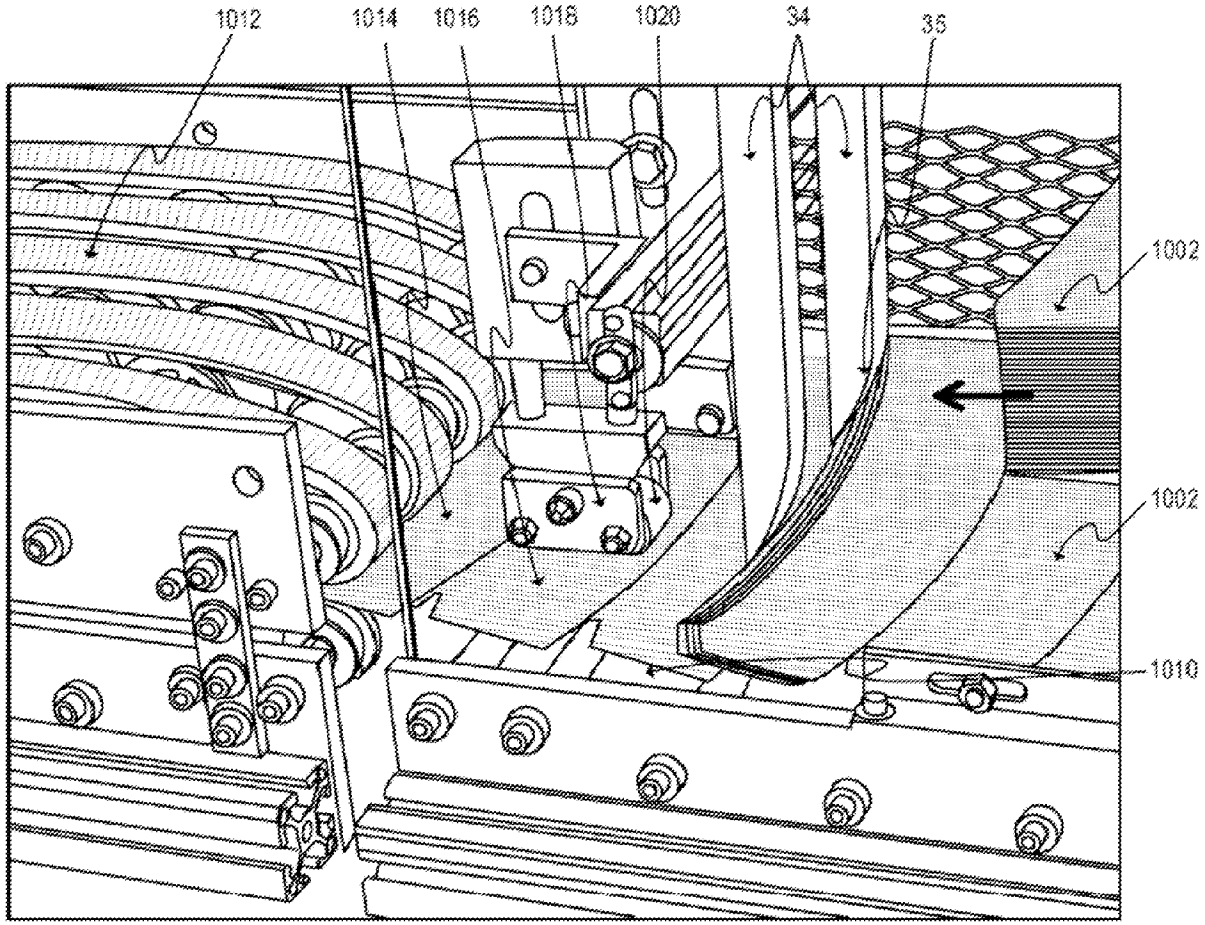
FIG. 3 is an enlarged perspective view of portions of the exemplary feeder system.

FIG. 3 is an enlarged perspective view of portions of the exemplary feeder system. Feed gate 34 may only allow one sheet 1002 of a stack of sheets 1002 to move forward past feed gate 34 at a time, as in FIG. 3. A bottom of feed gate 34 may include curved surfaces 35 to guide sheets 1002 and allow them to smoothly pass under feed gate 34 without damaging the sheets 1002 as a stack of sheets 1002 are moved forward by holder conveyor 1010.

Holder conveyor 1010 may move sheets 1002 forward past feed gate 34 to a separator, e.g., separating conveyor 1012. The terms holder conveyor and separator conveyor are used for purposes of explanation. The functions of the conveyors described herein can be implemented as part of the same conveyor or constructed from various different conveyors located in the same or different physical locations.

Separating conveyor 1012 may be located adjacent to holder conveyor 1010. Separating conveyor 1012 may include a separator mechanism, multiple belts, and rollers, in FIGS. 1, 2, and 3 to move sheets 1002. Separating conveyor 1012 may also be constructed of a single belt, with or without rollers, or other separator mechanisms to move sheets 1002. Separating conveyor 1012 may be configured to move sheets 1002 generally forward, as depicted from the left to right in FIG. 1 and from the right to left in FIGS. 2 and 3. Additionally or alternatively, separating conveyer 1012 may be configured to move sheets 1002 in a generally upward or downward direction in relation to the position of sheets 1002 on holder conveyor 1010. Separating conveyor 1012 may be driven by a series of belts, pulleys, and motors, in FIGS. 1, 2, and 3, or may be driven by any other mechanisms. Separating conveyor 1012 may be constructed of a top conveyor mechanism and a bottom conveyor mechanism, FIGS. 1, 2, and 3, or may be constructed of only one conveyor mechanism.

Separating conveyor 1012 may receive the leading edge of sheet 1002 while a portion of sheet 1002 is still in contact with holding conveyor 1010, in FIG. 3. For example, a first blank 1014 located at the leading edge of sheet 1002 contacts separating conveyor 1012 while a second blank 1016 on the same sheet 1002, and that is adjacent to the first blank 1014, is in contact with holding conveyor 1010.

A resistance mechanism 1018 may act on second blank 1016 on sheet 1002 to resist the forward movement of second blank 1016. Additionally or alternatively, resistance mechanism 1018 may act on second blank 1016 on sheet 1002 to resist an upward or downward movement of second blank 1016 while separating conveyor 1012 moves first blank 1014 upward or downward. An example of resistance mechanism 1018 is in FIG. 3. The resistance mechanism 1018 may not be acting on first blank 1014 while the resistance mechanism 1018 is acting on second blank 1016. Alternatively, there may be interaction between resistance mechanism 1018 and first blank 1014 while the resistance mechanism 1018 is in contact with second blank 1016.

Resistance mechanism 1018 may resist the forward movement of second blank 1016 by applying a resistance force to second blank 1016. The force applied by resistance mechanism 1018 may include, for example, a holding force, a downward directing force, an upward directing force, a reverse directing force, or any combination of forces configured to resist the forward movement of second blank 1016. Resistance mechanism 1018 may apply the force to second blank 1016 by simultaneously contacting the upper and lower surfaces of second blank 1016.

Additionally or alternatively, resistance mechanism 1018 may apply the resistance force to second blank 1016 by interaction between a portion of second blank 1016, such as a notch, groove, or hole, and a corresponding protruding portion of resistance mechanism 1018. Additionally or alternatively, resistance mechanism 1018 may apply the resistance force to second blank 1016 through an adhesive agent, such as a resin or glue located on resistance mechanism 1018. Additionally or alternatively, resistance mechanism 1018 may apply the resistance force to second blank 1016 through increased friction between resistance mechanism 1018 and second blank 1016 as compared to the friction between holding conveyor 1010 and the remainder of sheet 1002.

In FIG. 3, an example of resistance mechanism 1018 may include one or more rollers 1020 in contact with the upper surface of sheet 1002. The example in FIG. 3 includes two sets of roller pairs. The size and number of rollers may be modified to suit the size of the blanks in sheet 1002. Rollers 1020 may exert downward pressure on the blanks contained in sheet 1002. Rollers 1020 may allow forward movement of sheet 1002 while still applying downward pressure. The pressure exerted by resistance mechanism 1018 on sheet 1002 may be varied by adjusting resistance mechanism 1018, for example by raising or lowering resistance mechanism in relation to sheet 1002 or holder conveyor 1010. Resistance mechanism 1018 may be located above holder conveyor 1010, in FIG. 3. Alternatively, resistance mechanism 1018 may be located adjacent to holder conveyor 1010 or at another location upstream of separating conveyor 1012.

Figure 4:
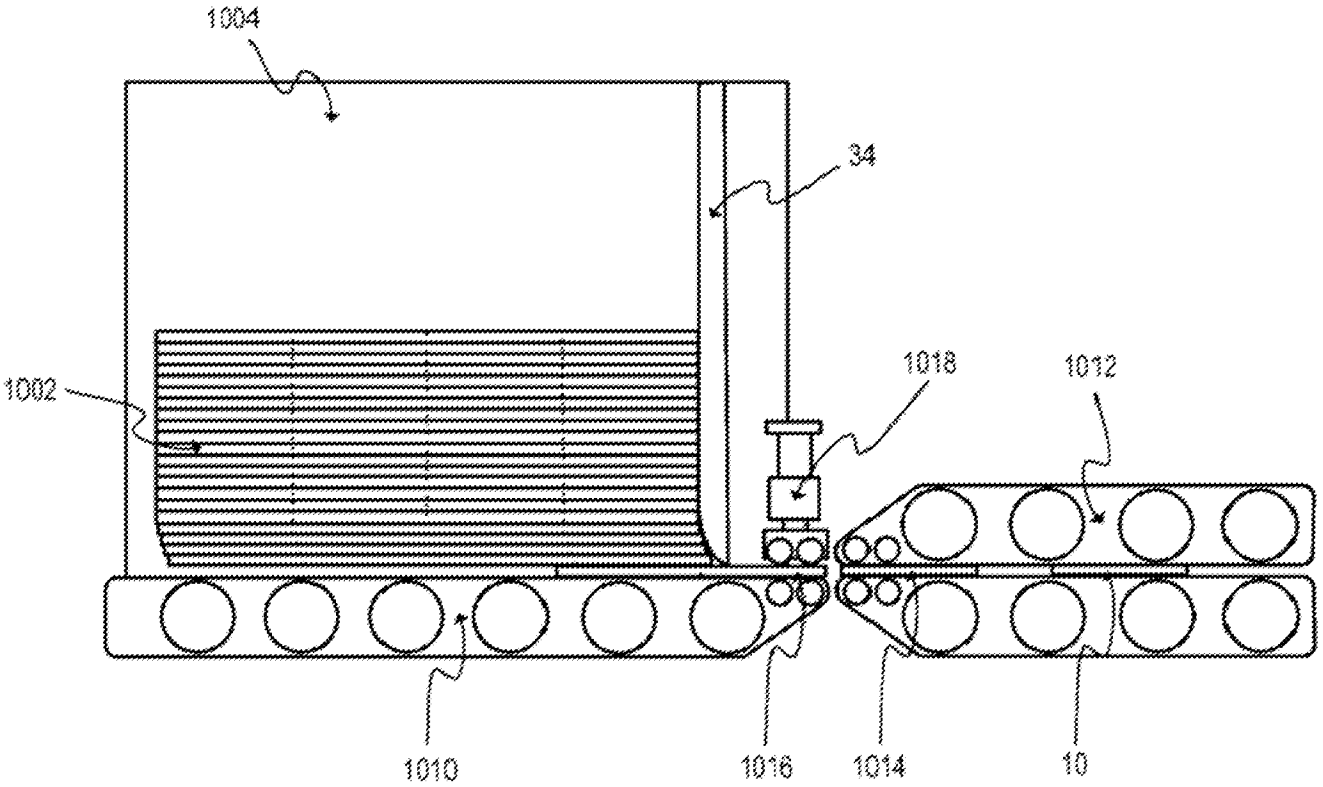
FIG. 4 is a side view of the exemplary feeder system.
Figure 5:
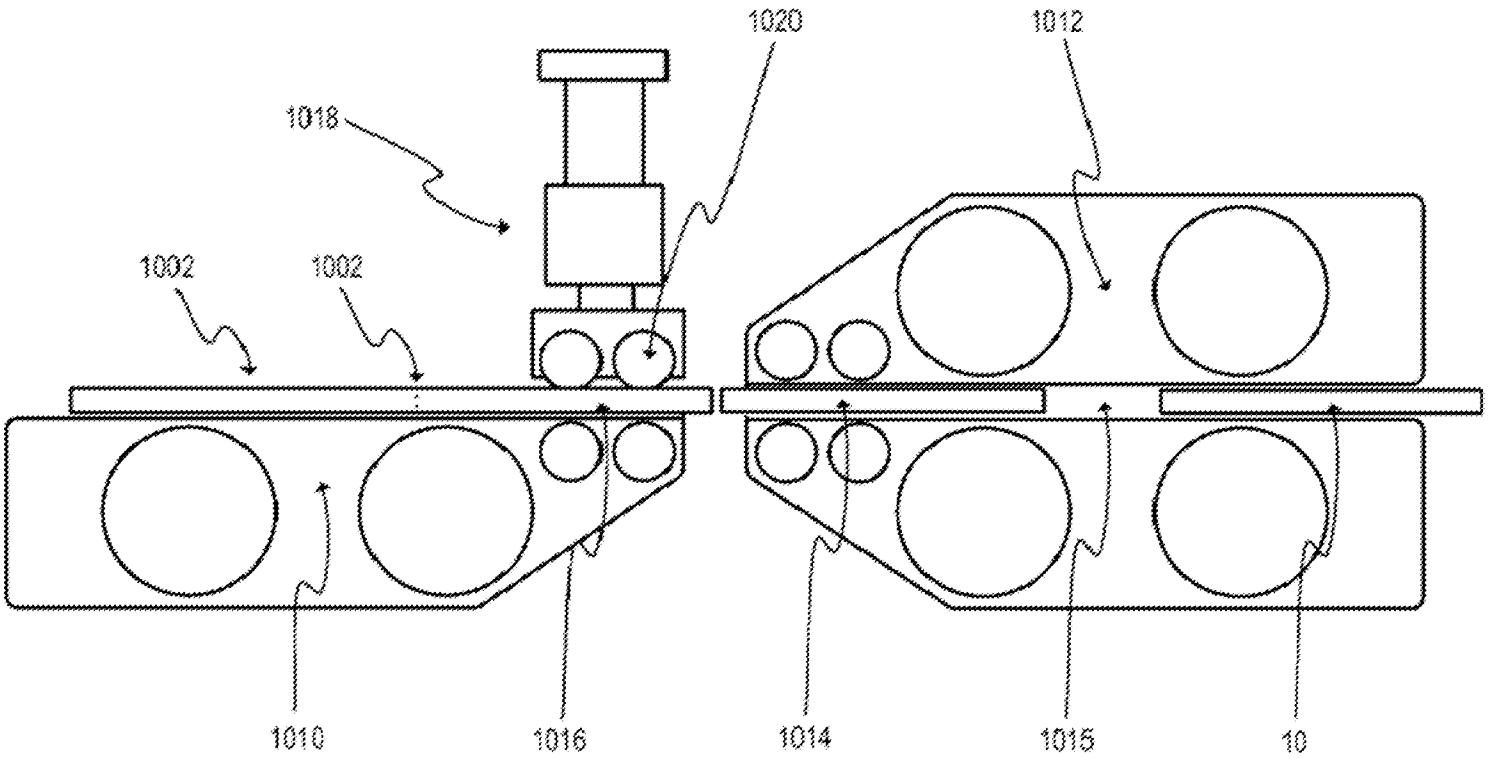
FIG. 5 is an enlarged side view of portions of the exemplary feeder system.

Separating conveyor 1012 may separate first blank 1014 from second blank 1016, as FIGS. 4 and 5. Separating conveyor 1012 may separate first blank 1014 from second blank 1016 by, for example, propelling first blank 1014 forward away from second blank 1016. Alternatively or additionally, separating conveyor 1012 may separate first blank 1014 from second blank 1016 by shifting first blank 1014 upward or downward away from second blank 1016. Separating conveyor 1012 may propel first blank 1014 forward by applying a force, such as a pulling force, to first blank 1014. Separating conveyor 1012 may apply the force to first blank 1014 by contacting the upper and lower surfaces of first blank 1014 with the top and bottom conveyor mechanisms, respectively.

Alternatively or additionally, separating conveyor 1012 may include a force application component or breaker, for example, a rotating component such as an arm, wheel, or other mechanism to impact first blank 1014. The force application component or breaker may propel first blank 1014 upward or downward by applying a force, such as a pulling force, to first blank 1014. Separating conveyor 1012 may propel first blank 1014 upward or downward by grasping or impacting first blank 1014 with a force directed in the upward or downward direction. The upward or downward direction may be oriented substantially perpendicular to the sheet of blanks.

Additionally or alternatively, separating conveyor 1012 may apply a force to first blank 1014 by interaction between a portion of first blank 1014, such as a notch, groove, or hole, and a corresponding protruding portion of separating conveyor 1012. Additionally or alternatively, separating conveyor 1012 may apply a force to first blank 1014 through an adhesive agent, such as a resin or glue located on separating conveyor 1012. Additionally or alternatively, separating conveyor 1012 may apply a force to first blank 1014 through increased friction between separating conveyor 1012 and first blank 1014 as compared to the friction between holding conveyor 1010 and sheet 1002.

FIG. 4 is a side view of the exemplary feeder system and FIG. 5 is an enlarged side view of portions of the exemplary feeder system. In FIGS. 4 and 5, first blank 1014 may be separated from second blank 1016, etc. A stack of sheets 1002 is shown in FIG. 4. The separating conveyor 1012 acting on a lead blank, e.g., first blank 1014 and resistance mechanism 1018 acting on a following blank, e.g., second blank 1016. Separating conveyor 1012 may propel first blank 1014 forward while resistance mechanism 1018 may resist the forward movement of second blank 1016. The combination of forces acting on first blank 1014 and second blank 1016 may separate, or tear, the blanks apart along the line 1022 joining them together.

Figure 6:
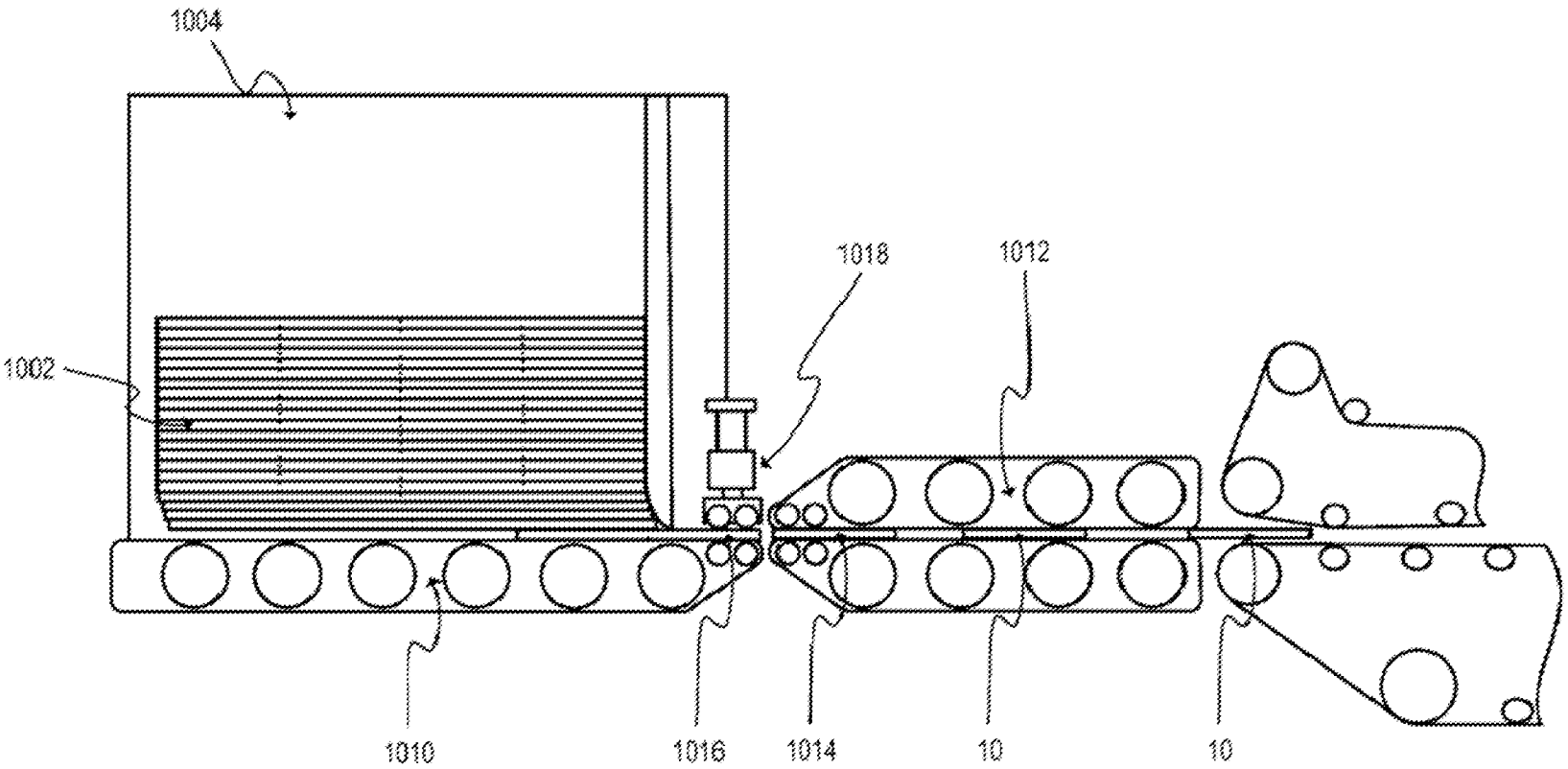
FIG. 6 is a side view of the exemplary feeder system at a beginning of an assembly process.

FIG. 6 is a side view of the exemplary feeder system at a beginning of an assembly process. The first blank 1014 and a previously separated blank 10 can be fed into various systems, machines, or methods for further processing, for example, in FIG. 6 and FIGS. 13-22. Furthermore, after first blank 1014 is separated from sheet 1002, the blank that was previously second blank 1016 may become the new first blank 1014 because it is now on the leading edge of sheet 1002. The blank adjacent to the leading edge blank may become the new second blank 1016. This process may repeat for all the blanks contained in sheet 1002.

Separating conveyor 1012 may be configured to move sheets 1002 at the same rate or a different rate as holding conveyor 1010. For example, separating conveyor 1012 can operate at a faster rate than holding conveyor 1010 to create spacing 1015 between the individual blanks 10 as the blanks 10 are moved forward, in FIGS. 4, 5, and 6. Correct spacing between blanks 10 may allow for proper operation of downstream processes. The rates of holding conveyor 1010 and separating conveyor 1012 may be variable and may be adjusted based on any desired operating parameter, such as, matching the rate of downstream processes or matching the rate of upstream sheet feeding processes. Holding conveyor 1010 and separating conveyor 1012 may be driven by variable speed motors.

Figure 7:
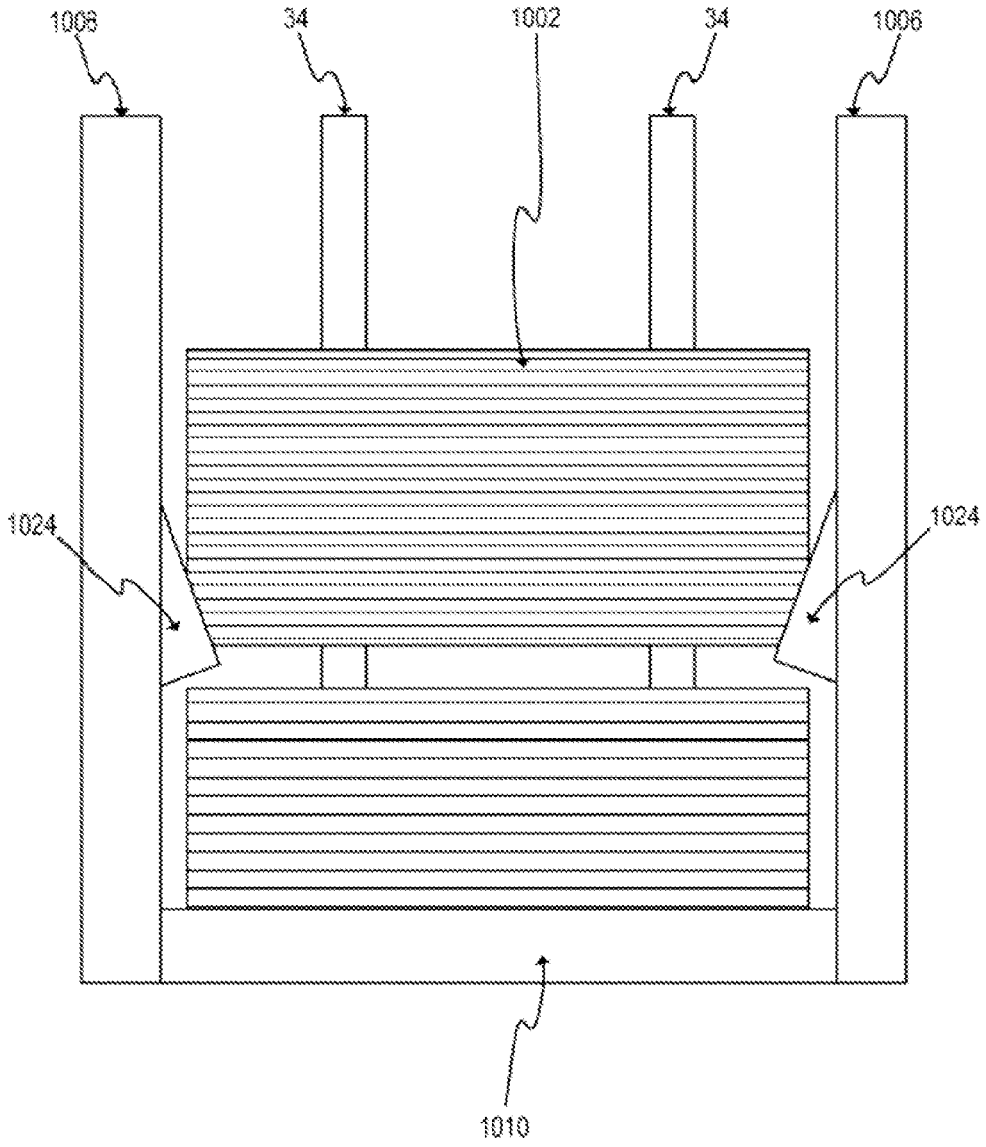
FIG. 7 is a front view of an exemplary holder and support mechanism of the exemplary feeder system.
Figure 8:
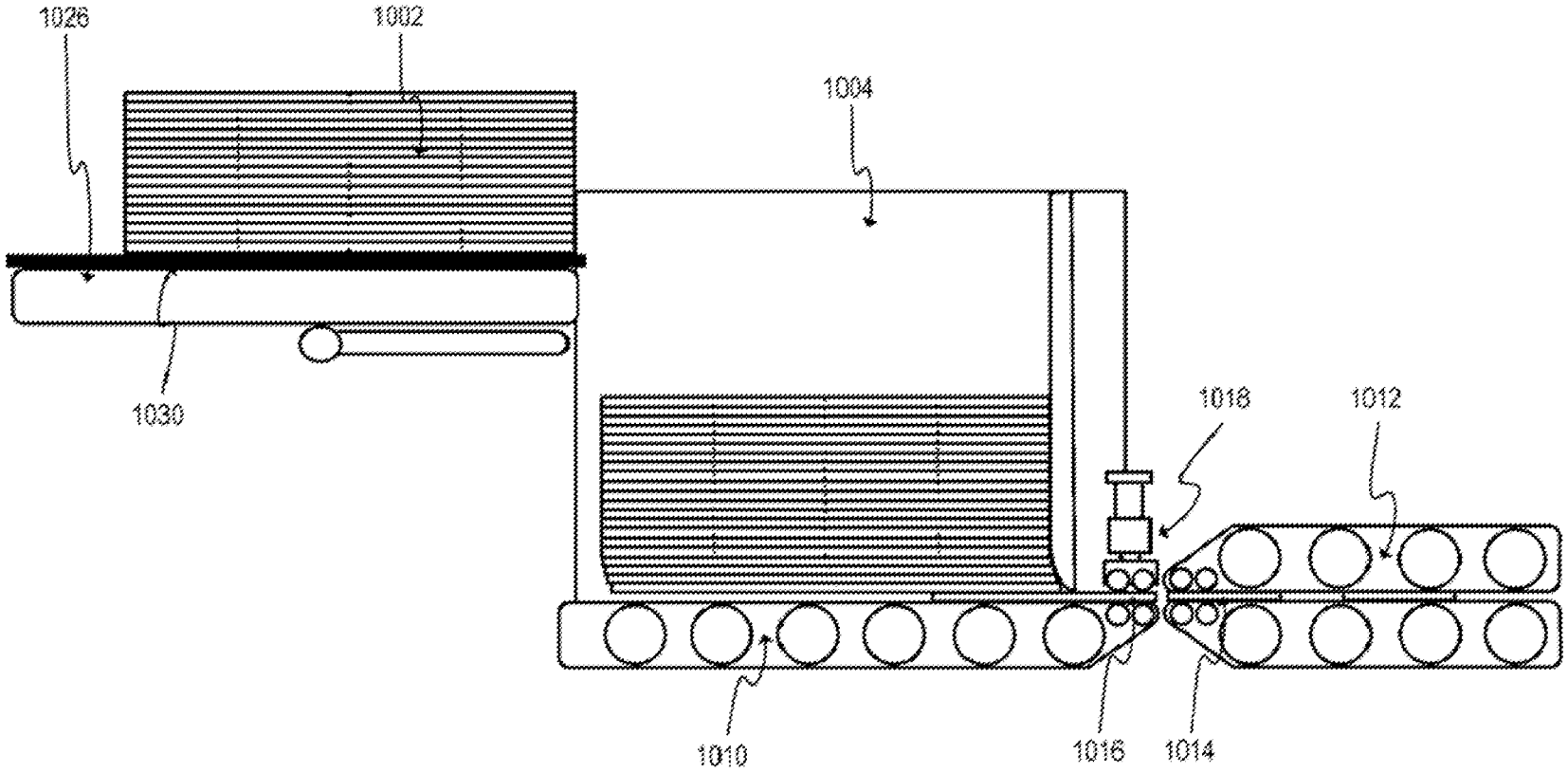
FIG. 8 is a side view of the exemplary feeder system and an exemplary optional sheet loader feature.
Figure 9:
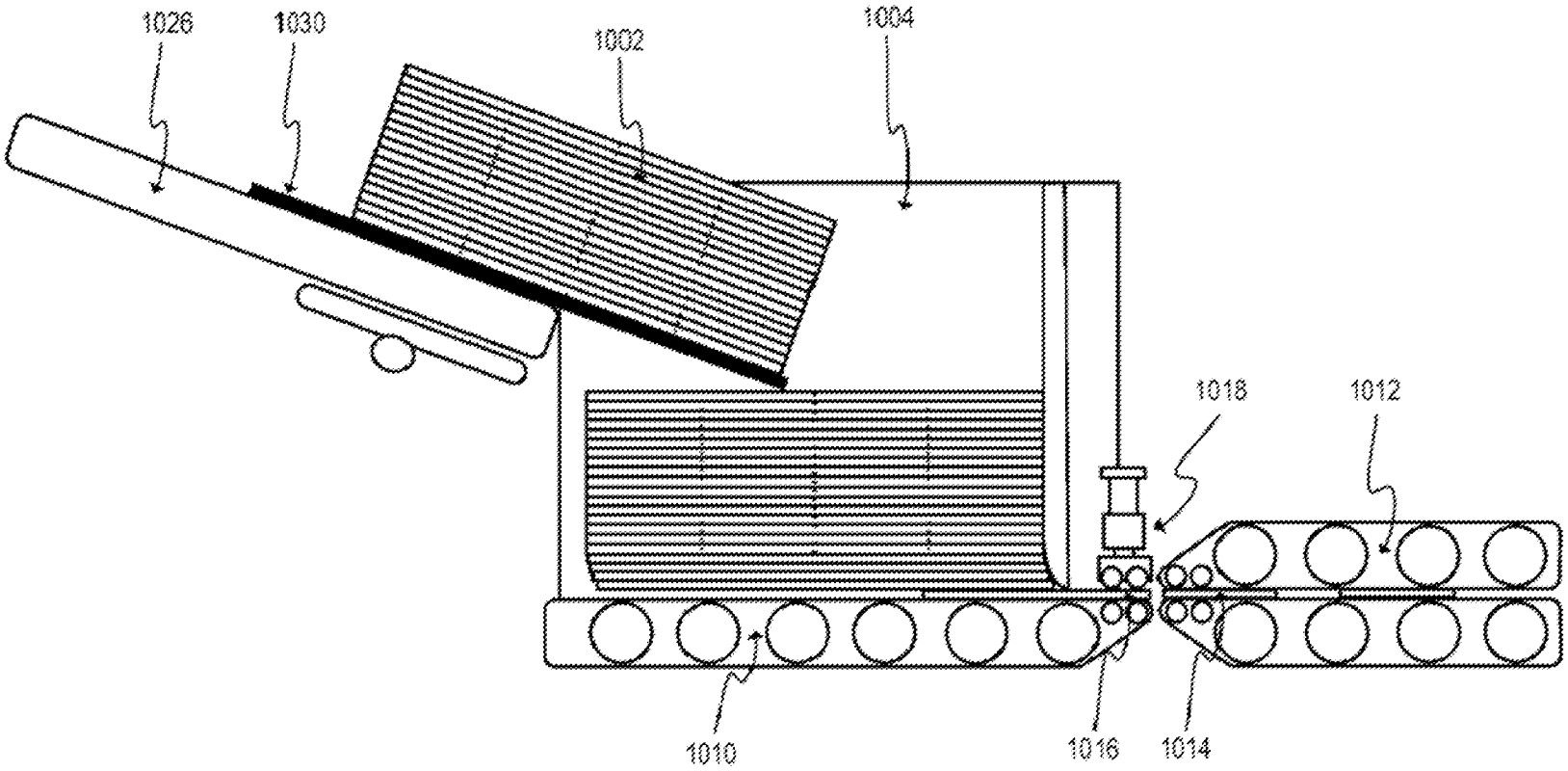
FIG. 9 is another view of the exemplary feeder system and the exemplary optional sheet loader feature.

Additional features are shown in FIGS. 7-10. FIG. 7 is a front view of an exemplary holder and support mechanism of the exemplary feeder system. FIG. 8 is a side view of the exemplary feeder system and an exemplary sheet loader feature. FIG. 9 is another view of the exemplary feeder system and the exemplary sheet loader feature. In FIG. 7, holder 1004 may include a support mechanism 1024 to support a number sheets 1002 above the base of holder 1004 or above holding conveyor 1010. Support mechanism 1024 may reduce the pressure exerted on holding conveyor 1010 from a stack of sheets 1002 contained in holder 1004 by supporting a number of sheets 1002 above holding conveyor 1010. Support mechanism 1024 may include a number of movable support members that selectively allow sheets 1002 to drop down or pass through depending on a parameter, such as the number of sheets above or below support mechanism 1024.

In the example of support mechanism 1024 in FIG. 7, two support members may be attached to side panels 1006 and may recede away from sheets 1002 to allow one or more individual sheets 1002 to drop onto a stack of sheets 1002 supported by holding conveyor 1010. The movement of support members away from sheets 1002 may be controlled or varied by automatic mechanisms such as, for example, springs, hydraulics, or friction, or may be controlled by a computer or an operator. The rate at which support mechanism 1024 allows sheets 1002 to drop down or pass through may be adjusted to be any rate, such as, for example the rate that holding conveyor 1010 moves sheets 1002 forward.

In FIGS. 8 and 9, a sheet loader 1026 may be included that is configured to deliver one or more sheets 1002 to holder 1004. Sheet loader 1026 may be at the end of a separate process or system that creates sheets 1002 or delivers sheets 1002 to holder 1004. Sheet loader 1026 may pivot from a horizontal position, in FIG. 8, to a titled position, in FIG. 9, to deliver sheets 1002 to holder 1004. Sheets 1002 may exit sheet loader 1026, such as, for example, by sliding along a surface of sheet loader 1026. Sheet loader 1026 may be designed to pivot once a determined quantity of sheets 1002 are included on sheet loader 1026 and are ready to be delivered to holder 1004. The pivot of sheet loader 1026 may be controlled by automatic mechanisms such as, for example, springs or hydraulics, or may be controlled by a computer or an operator. The quantity of sheets 1002 and rate at which sheet loader 1026 delivers sheets 1002 to holder 1004 may be adjusted to be any rate, such as, for example the rate that holding conveyor 1010 moves sheets 1002 forward. Additionally or alternatively, sheet loader 1026 may include a plate 1030 that sheets 1002 are positioned on before being delivered to holder 1004, as shown in FIGS. 8 and 9. Plate 1030 may be designed to be removed to allow a determined quantity of sheets 1002 to be delivered to holder 1004.

Figure 10:
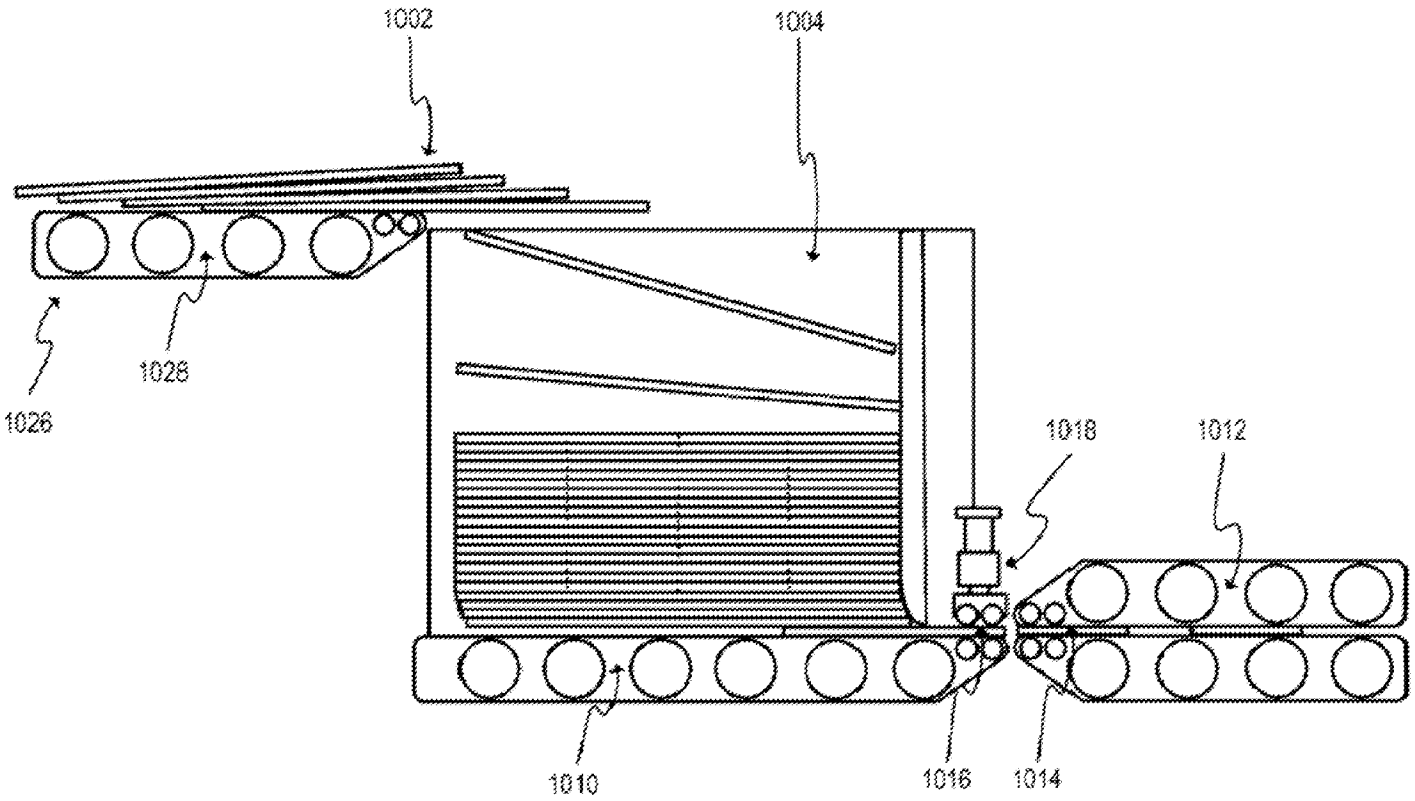
FIG. 10 is a side view of the exemplary feeder system and an alternative example of the sheet loader feature.

FIG. 10 is a side view of the exemplary feeder system and an alternative example of the sheet loader feature. In FIG. 10, sheet loader 1026 includes a loader conveyor 1028 configured to deliver one or more sheets 1002 to holder 1004. Loader conveyor 1028 may be constructed of multiple belts and rollers, similar to the other conveyors described herein. Loader conveyor 1028 may convey one or more sheets 1002 to holder 1004 on a moving surface located on loader conveyor 1028. Sheets 1002 may drop into holder 1004 after exiting loader conveyor 1028. The rate at which loader conveyor 1028 delivers sheets 1002 to holder 1004 may be adjusted to be any rate, such as, for example the rate that holding conveyor 1010 moves sheets 1002 forward.

Individual blanks 10 obtained from sheets 1002, as described herein, may be used in any process or machine utilizing blanks. As one example, a method and machine to produce beverage container holders is described.

Blanks of other designs and raw material substrates, such as corrugated, chip board, plastic, and other alternative materials, could be used in practicing the method described and processed with the machine described. However, the blanks disclosed herein and used in the example disclosed may have a single linerboard and a single fluted corrugation. Although beverage container holders of other final designs could be produced using the method and machine disclosed herein, the final product disclosed may have the fluted surface in contact with the beverage container and may have the linerboard side on the exterior. Indicia can be provided on the outer linerboard surface. As will be presently discussed, each blank may be folded along predetermined fold lines. Perforations may be produced in the blank along these fold lines in the production of the blanks.

The feeder systems described above and shown in FIGS. 1-10 may separate sleeve blanks from sheets of blanks or may be used to separate any other various types of blanks from sheets, such as, for example, boxes, cups, lids, or any other blank cutout from a sheet. The sheets and blanks may be composed of any material, such as paper products, corrugated, chip board, plastic, and other alternative or recyclable materials. After separation from the sheets, the blanks may be used in a variety of processes. For example, the blanks may be manually formed into sleeves or other shapes, or the blanks may be placed directly or indirectly into various other machines and systems for various further processing or manufacturing, such as cutting, gluing, folding, forming, or combining. The method and machine described below and shown in FIGS. 11-24 is merely one example of a further process that the blanks may be used in.

In the following exemplary discussion of the method and machine 100 for producing beverage container holders from blanks 10 into a final product 500, directions, such as forward, left and right, may be determined from a position in front of the machine 100 looking in the direction that the blanks advance during the processing steps. The machine 100 may extend longitudinally over a considerable length and may include a number of work stations along its length. In the subsequent exemplary discussion, work stations along the left and right sides may be discussed. When discussing work stations on the left side of the machine 100, the direction of movement of the blanks 10 may be indicated by the direction of an arrow A and, when discussing work stations on the right side of the machine, the direction of movement of the blanks 10 may be indicated by the direction of an arrow B. In the one example of the method and machine, there may be an operator at the finishing end of the machine who loads the finished product 500 into shipping cartons. In the example of the machine, the steps of converting blanks into the finished products may be automatically performed by the machine as the blanks are conveyed by the machine 100 along its longitudinal length. The conveyors for conveying the blanks 10 along the length of the machine 100, as well as the mechanism for performing the processing steps on the blank, may all be carried by or supported by the machine frame 102. The starting end of the machine may be adjacent to the end of the feeder system previously described, allowing blanks 10 to be fed from the feeder system directly into the machine.

Figure 11:
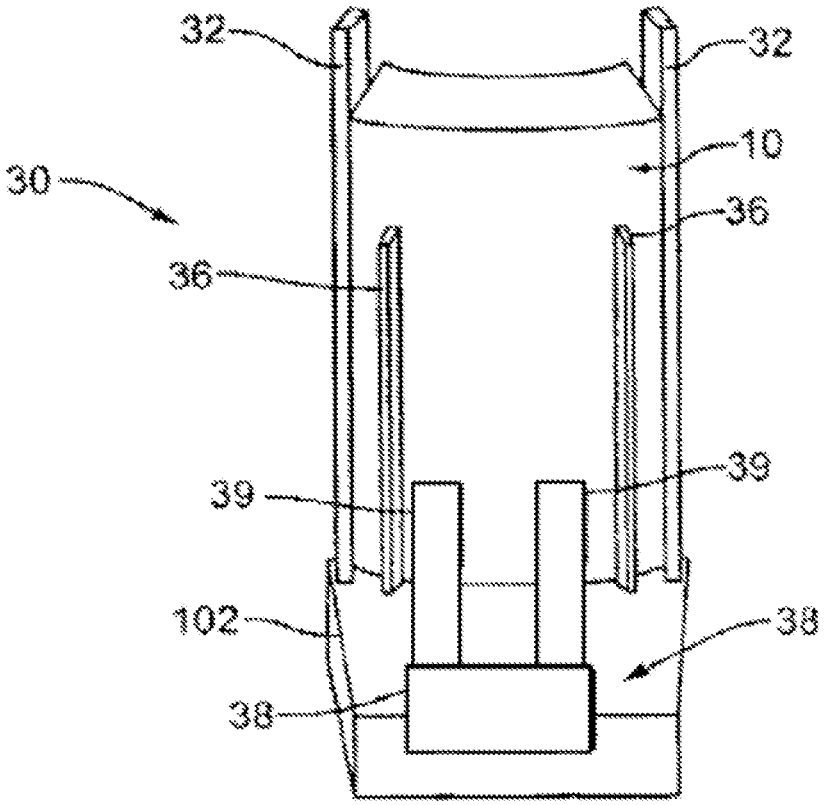
FIG. 11 is a front perspective view of an exemplary vertical containment apparatus.

FIG. 11 is a front perspective view of an exemplary vertical containment apparatus 30. The feeder system previously described may deliver individual blanks 10 into a vertical containment apparatus 30 at the starting end of the machine. The blanks 10 may then be sequentially released onto a set of introductory belts 50, see FIG. 12, that conveys them into the mouth 101 of the conveying mechanism of the machine 100. The speed of producing beverage container holders may be greatly increased as a result of the exemplary machine and method disclosed herein.

The vertical containment apparatus 30 may include side panels 32, connected to the machine frame 102 that function to prevent the blanks 10 from moving to the left or right, and a pair of back braces 36 that may function to hold the stack of blanks perpendicular to the mouth 101 of the machine 100 and may prevent the stack from falling.

Figure 12:
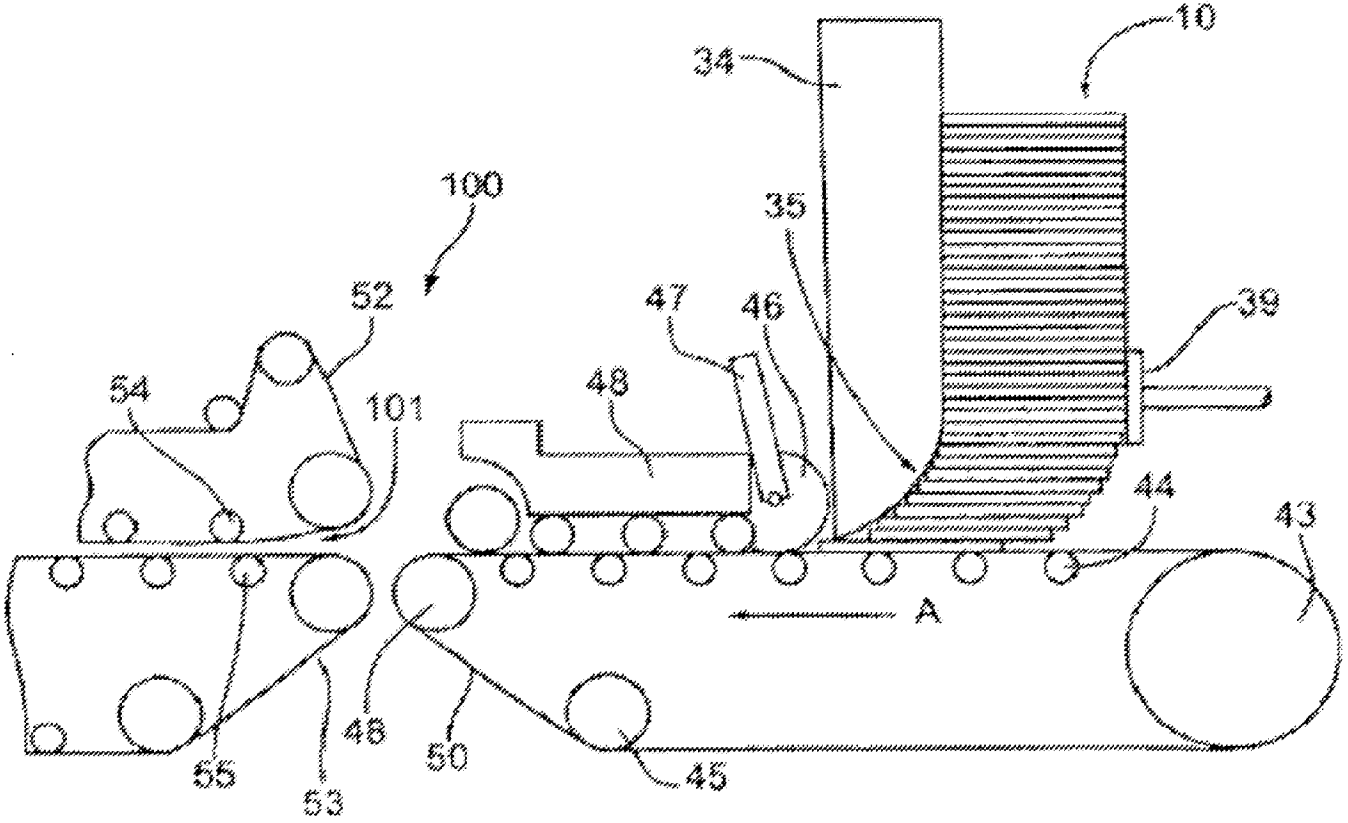
FIG. 12 is a side view of an exemplary feed gate area of an exemplary machine for forming beverage container holders.
Figure 13:
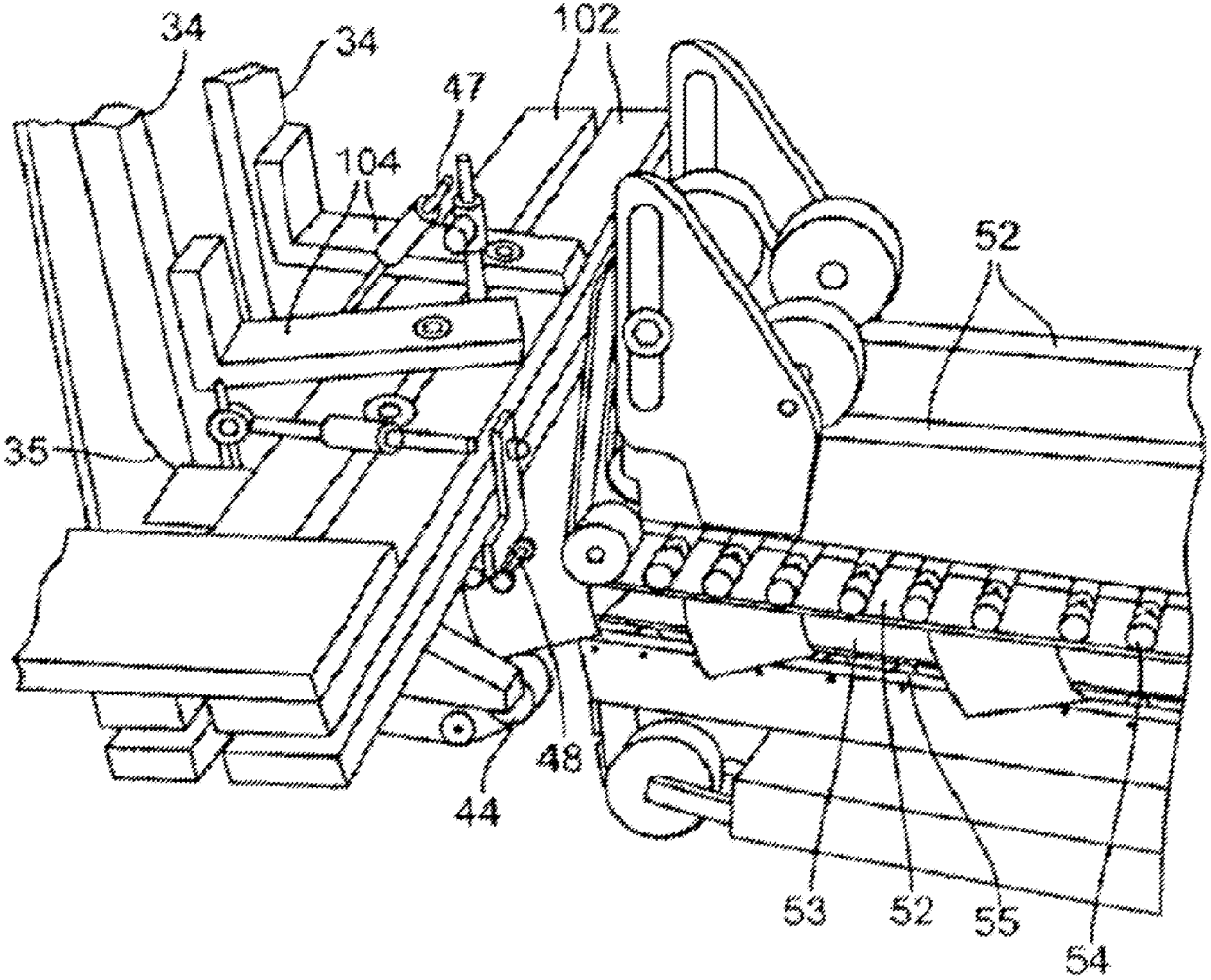
FIG. 13 is a perspective view of the exemplary feed gate and the mouth of the machine areas of the exemplary machine.

In FIGS. 12 and 13, the vertical containment apparatus 30 may include feed gate 34 having curved surfaces 35 along its bottom edges. Curved surfaces 35 may function to guide the blanks 10 as they are sequentially conveyed forward from the bottom of the stack by the introductory belts 50. Feed gate 34 may be supported by the machine frame 102, see FIG. 13, through L-shaped mounting bars 104. Feed gate 34 may be connected to the L-shaped mounting bars 104 through a mechanism that allows feed gate 34 to be finely adjusted in the vertical direction. This adjustment may accommodate for the thickness of the blanks. When a shipment of blanks are received, they may generally be of a uniform thickness. However, occasionally within a shipment of blanks as well as batches of blanks from a different manufacturer, there may be blanks of a slightly different, general thickness. When this occurs, feed gate 34 may be adjusted relative to the upper surface of the set of introductory belts 50 such that a single blank 10 can pass under feed gate 34 when supported on the introductory belts 50.

The height of the vertical containment apparatus 30, as well as the supporting brackets 32, 34, 36, may be custom designed to introduce blanks into the machine at the high rate that this machine has the capacity to produce finished products. The brackets 32, 34, 36 also function to prevent the blanks from bending as they enter the mouth 101 of the machine 100.

The vertical containment apparatus 30 may also include a vibrator 38 including flat pads 39 that bear against the back surface of the stack of blanks near the bottom of the stack.

FIG. 12 is a schematic side view in which some structure, such as the side bar 32 and the machine frame 102, may not been shown to better illustrate the relationship between feed gate 34 and the set of introductory belts 50 that may function as a feed gate for the individual blanks 10. It should be noted that individual blanks 10 may be fed from the bottom of the stack of blanks 10 held in the vertical containment apparatus 30.

In FIG. 12, the left feed gate 34 is shown and it should be understood that an identical right feed gate 34 may be hidden in this view by the left bracket 34. The front surface of the stack of blanks 10 may be in engagement with the rear surface of the front brackets 34. Feed gate 34 may have curved surfaces 35 at their lower ends. The vibrator 38 may cause the blanks 10 at the bottom of the stack to move forward following the curved surfaces 35 of feed gate 34. Below the stack of blanks 10 may be a set of spaced introductory belts 50 that are driven, in the direction of arrow A in FIG. 12, by a drive drum 43. The set of drive belts 50 may extend across the entire width of the blanks 10. There may be a plurality of rollers 44 below the drive belts 42 and a take-up roller 45 for maintaining the belts taut. The bottom blank 10 in the stack may rest on the upper surface of the set of drive belts 50 and may be conveyed forward thereby. Feed gate 34 may be adjusted relative to the upper surface of the set of drive belts such that there may be a gap there between sufficient to permit one blank 10 to pass under the bottom tip of feed gate 34. When a blank 10 emerges from under feed gate 34, it may encounter a central hold down roller 46 carried by a mounting rod 47 as well as banks of roller wheels 48 at the right and left ends of the blank 10. The central hold down roller 46 and the bank of roller wheels 48 may be supported by the machine frame 102, see FIG. 13.

In FIG. 12, the left bank of roller wheels 47 may be visible which may hide the right bank of roller wheels 47. The central hold down roller 46 and the right and left banks of roller wheels 47 may exert a downward pressure on the top surface of the blanks 10, holding the blanks 10 into engagement with the set of introductory belts 50. This positive control of the blanks 10 as they are about to be fed into the mouth 101 of the machine 100 may provide proper operation of the machine 100. If a blank 10 is fed into the mouth 101 of the machine 100 in a crooked or twisted condition, the machine 100 may become jammed. This may necessitate stopping the machine to remove the jam and involves down time which is highly undesirable.

The blanks 10 may be placed in the vertical containment apparatus 30 with their fluted or corrugated side facing up and the concave arcuate bottom edge 11 being the leading edge as it enters the mouth 101 of the machine. The speed of the set of introductory belts 50 can be adjusted to thus control the rate that the feed gate introduces blanks into the mouth 101 of the machine. This may allow the spacing between the blanks 10 as they proceed through the machine to be adjusted.

After the blank 10 is received in the mouth 101 of machine 100, it may be continuously advanced through the machine 100 at a constant speed or rate until the completed product 500 reaches the final stage at which its forward speed may be reduced and the finished product 500 assume an imbricated formation. In this imbricated formation, the trailing edge of each finished product may overlie and may be supported by the finished product 500 that is trailing it. Thus, the series of steps or processes that are performed on the blank to produce the finished product may be performed while the blank 10 is moving at a constant speed. The blank 10 may never stops its forward movement as it advances through machine 100.

The set of introductory belts 50 may be relatively short and feed the blank into the mouth 110 of the machine which may include sets of upper 52 and lower 53 belts. Each set of belts 52 and 53 may include two relatively narrow ribbon-shaped belts that may be horizontally spaced from each other. The belts of the upper set 52 overlie the belts 53 of the lower set. As best seen in FIG. 13, the sets of belts 52 and 53 may be narrower than the blanks 10 and, thus, the right and left ends of the blanks 50 may extend in cantilevered fashion from the sets of belts 52 and 53. The sets of belts 52 and 53, as in FIG. 13, may not extend the entire length of the machine. Rather, a series of sets of upper and lower belts may cooperate to convey the blanks along the length of the machine 100. However, throughout the length of the machine, all upper belts may be identified by reference number 52 and all lower belts may be identified by reference number 53. The upper surface of the lower rung of upper belt 52 may be engaged by a series of freely rotating rollers 54 that function to exert a downward pressure on the blanks 10 and insure their constant movement along with belts 53. The lower surface of the upper rung of lower belt 53 may be supported by a series of freely rotating rollers 55 that extend normal to the direction of travel of belt 53. The sets of belts 52 and 53 may be narrower than the blanks 10 and the blanks 10 may rest on lower belt 53 such that both ends extend in cantilever fashion from the longitudinal edges of the belts. This arrangement may allow access to the free ends of the blanks by the various processing devices as the blanks advance along the length of the machine while the belts 53 and 54, as well as the subsequent sets of upper and lower belts, maintain positive control of the blanks 10. The speed of the belts 52 and 53 may be adjusted through the belt drive mechanisms. It should be noted that, when the machine 100 is operating, there may be a series of blanks 10 rather than a single blank as shown here for illustrative purposes.

Figure 14:
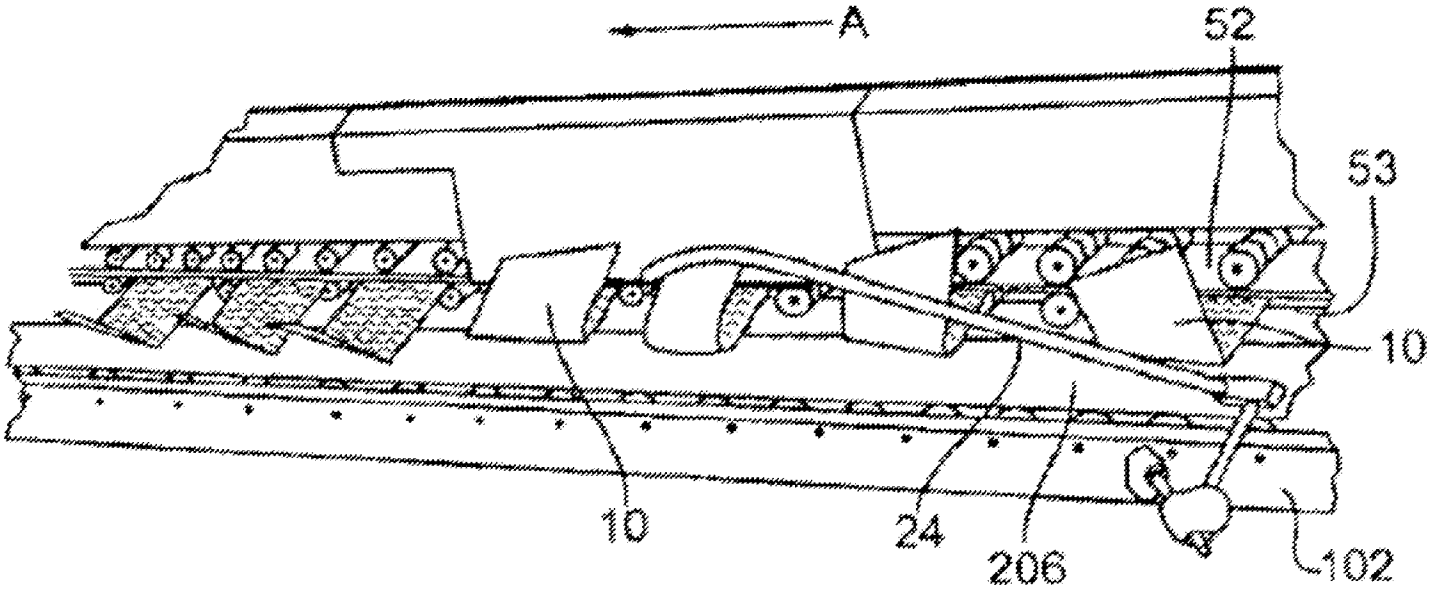
FIG. 14 is a perspective view of an exemplary mechanism for pre-breaking the left flap of the blank.

The blanks 10 may move to the pre-brake station illustrated in FIG. 14. This station may be located on the left side of the machine 100 and the left glue flap 19 may be processed at this station. The left glue flap 19 may be pre-folded along the perforated radial fold line 16 at this station. A brake bar 24 or folding shoe, that may be mounted on the machine frame 102, may extend upwardly toward the machine and to the left, in FIG. 14. The lower surface of the horizontally extending left glue flap 19 may encounter the brake bar 24 and may ride up on the bar causing the flap to bend or brake upwardly toward a vertical position along the perforated radial fold line 16 and then fold downwardly toward a folded over horizontal position. A belt 206 may underlie the free ends of blanks 10 that are being transported between belts 52 and 53. After the folded left glue flap 19 moves past the brake bar 24, it may be free to unfold back toward a horizontal attitude.

Figure 15:
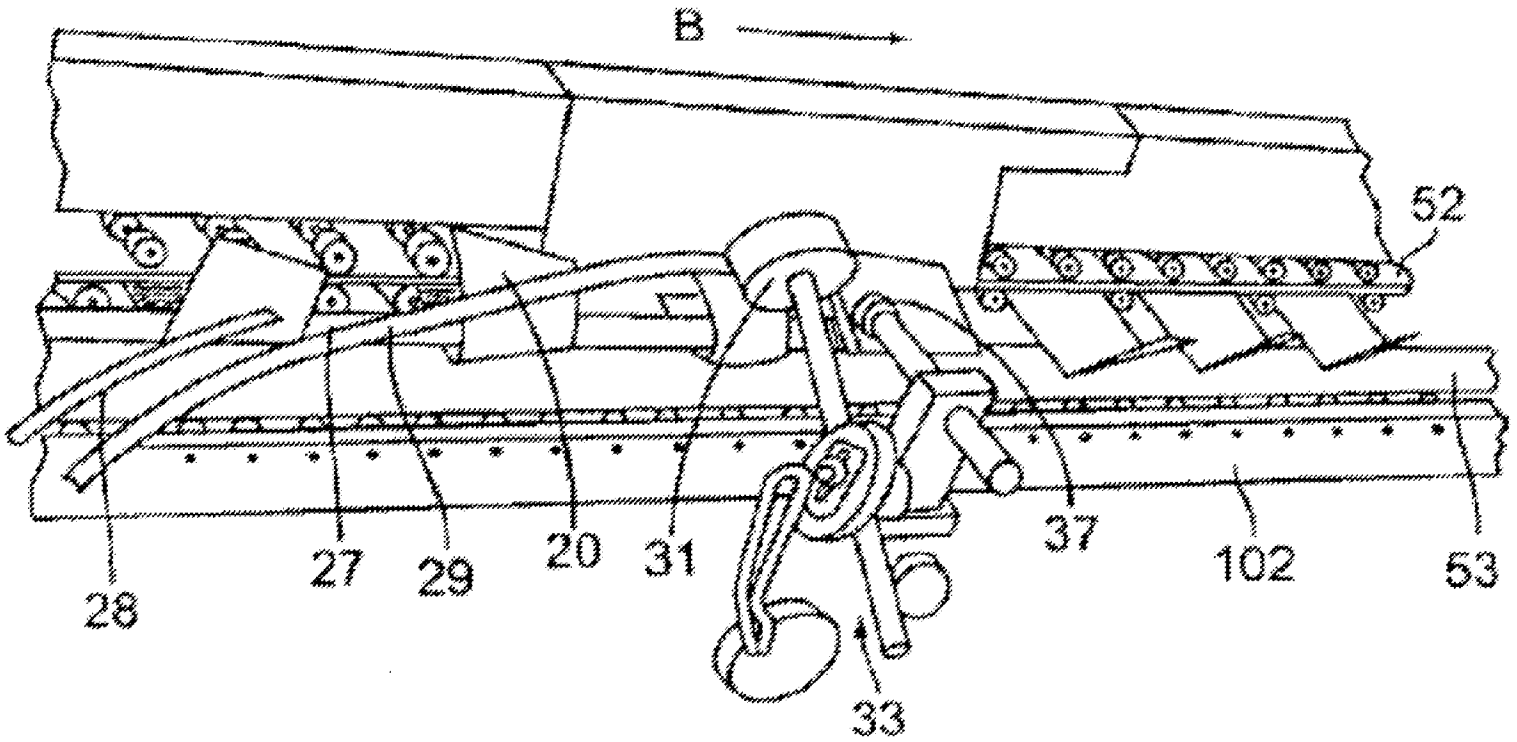
FIG. 15 is a perspective view of an exemplary mechanism for pre-breaking the right flap of the blank.

In FIG. 15, the pre-braking operation is shown for the right overlap flap 20. This operation may occur on the right side of the machine 100 and the blanks 10 may be moving in the direction of the arrow B. The right overlap flap 20 may be folded along the perforated radial fold line 17 at this station. A bend bar 27 that may be mounted on the machine frame 102 extends horizontally along the upper surface of the blanks 10 over the central section 18 of the blanks 10. Bend bar 27 may function to maintain the central section 18 horizontal as the right overlap flap 20 is bent along perforated radial fold line 17. A first, relatively short brake bar 28, that may be mounted on the machine frame 102, may extend upwardly toward the machine and to the right, in FIG. 15. The lower surface of the horizontally extending right overlap flap 20 may encounter brake bar 28 and may ride up on the bar causing the flap to bend or brake upwardly toward a vertical position along the perforated radial fold line 17. A second, longer brake bar 29 may then encountered by the right overlap flap 20 which may cause the right overlap flap 20 to begin folding downwardly toward a folded over horizontal position. The folded down right overlap flap 20 then may encounter a freely rotating press roller 31 that may function to continue pressing the flap 20 toward the horizontal position. The freely rotating press roller 31 may be carried by a holder 33 that may be supported on the machine frame 102. The folded over right overlap flap 20 then may encounter a creasing member 37 that may crease the fold along perforated radial fold line 17. After the folded right overlap flap 19 moves past the creasing member 37, it may be free to unfold back toward a horizontal attitude.

Figure 16:
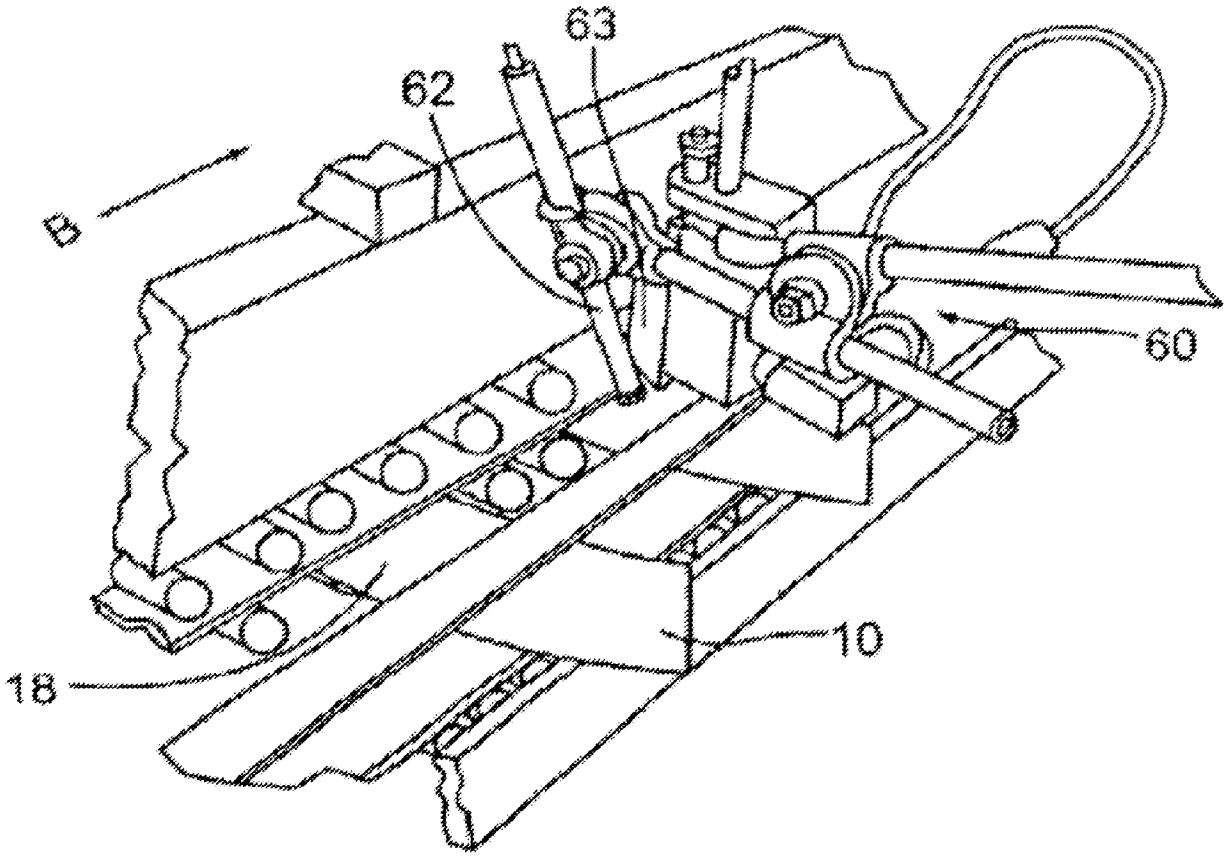
FIG. 16 is a perspective view of an exemplary work station at which the adhesive is applied.

In FIG. 16, a station may apply the adhesive 22 to the blank 10. The view in FIG. 16 is on the right side of the machine and the blanks 10 may be moving from left to right in this view. In this view of a station for applying the adhesive 22, the adhesive 22 may be applied to the fluted or corrugated central section 18 of the blank 10. The mechanism in FIG. 16 may be duplicated and, thus, not illustrated on the left side of the machine, and the adhesive on the left side of the machine may be applied to the fluted or corrugated side of the left glue flap 19. A holder mechanism 60, that may be supported by the machine frame 102, may be located above the blanks 10 at these stations. Electric eyes 62 may be carried by the holder mechanisms. The electric eyes 62 may sense the leading edge 11 of the blank 10 and may send a signal to the machines control mechanism which, in turn, may send a signal to a mechanism that causes the adhesive 22 to be dispensed through the dispensing mechanisms 63 carried by the holders 60. As a result, two lines of adhesive 22 may be deposited on the fluted surface of the blank 10. This adhesive may soften in response to the hot beverage in the cup and cause the holder to adhere to the cup.

Figure 17:
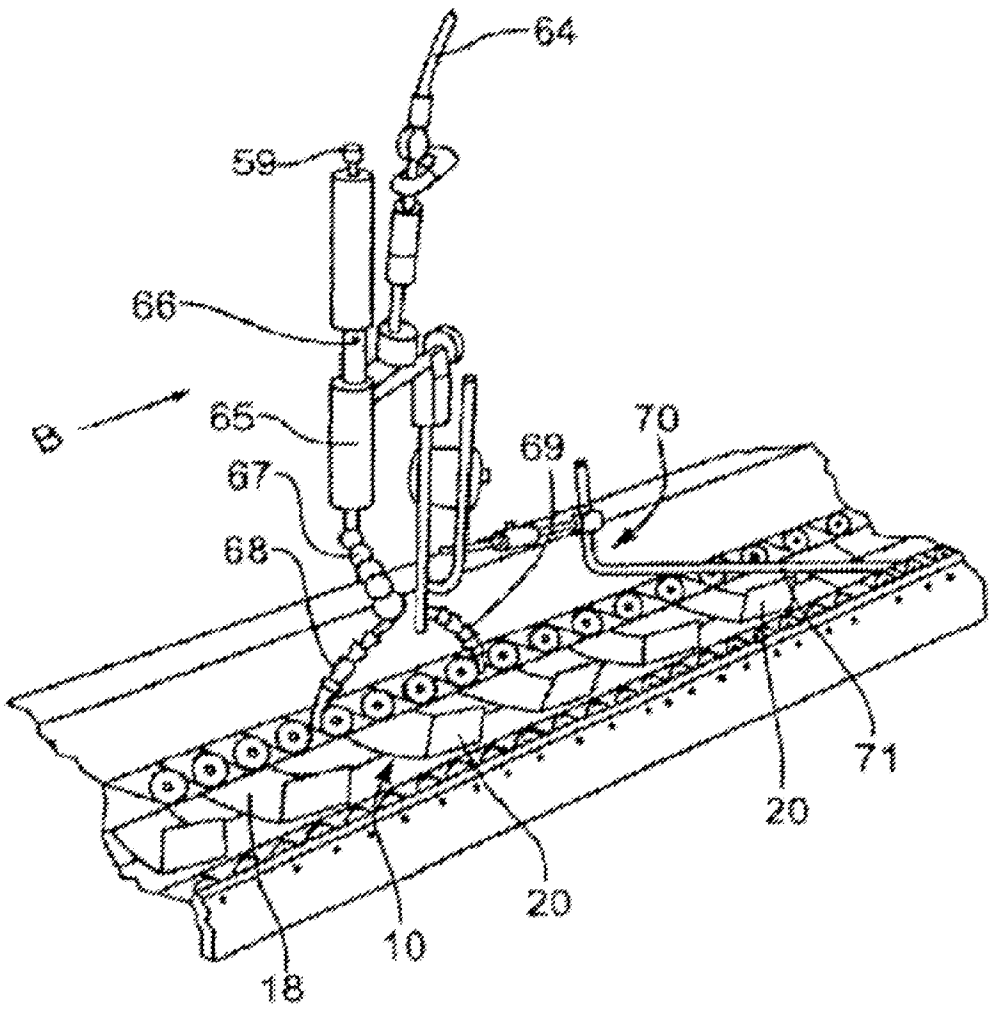
FIG. 17 is a perspective view of an exemplary work station at which cold air may be applied to the adhesive.

FIG. 17 shows the work station at which cold air may be applied to the adhesive 22 that may have been deposited on the fluted surface of the central section 18 of the blank 10. The view in FIG. 17 is on the right side of the machine 100 and the blanks 10 may be moving from left to right. In this view, the adhesive 22 may have been applied to the fluted or corrugated central section 18 of the blank 10 and, thus, cold air may be directed to this area of the blank 10. The mechanism in FIG. 17 may be duplicated and, thus, not illustrated on the left side of the machine. The only difference in this device on the left side of the machine may be that the adhesive 22 that is being chilled was deposited on the left glue flap 19 rather than the central section 18. Pressurized air may be received at these stations through tubes 64. The pressurized air is cooled and streams of freezing air may be directed on the adhesive 22. This step may crystallize the adhesive 22 sufficiently that it may lose its ability to adhere or tack to the other side of the blank when the glue flap 19 and overlap flap 20 are folded over and pressed down in the area at which the adhesive 22 was applied.

In an example of the machine, ambient air that has been pressurized may be fed through a vortex tube that converts a portion of the ambient air into a cold stream of air. In a vortex tube, the compressed air may be throttled through nozzles that divide the air into hot and cold fractions that flow from opposite ends of the vortex tube. By controlling the relative dimension of the parts, the proportions of the hot and cold fractions can be adjusted. Reference can be made to U.S. Pat. No. 3,173,273 for a more complete disclosure of the method of operation of a vortex tube. The vortex tube may be located in the cylindrical-shaped section 65 which may be close to the point where the chilled air functions to crystallize the adhesive 22. An orifice of the vortex tube can be opened and dosed by a knob 59 which enables the temperature of the air being dispensed to be maintained at the desired temperature regardless of the surrounding air temperature. The hot air may be exhausted through ports 66. Of course, a refrigeration unit could be used to supply freezing air for this cold air dispenser. The cooled air may flow through a main branch 67 of a plastic air dispensing tube which then splits into first dispensing section 68 and second dispensing section 69, each of which terminates in a nozzle. The first dispensing section 68 may discharge cold air on the adhesive 22 which then may receive a second blast of cold air from the second dispensing section 69.

In FIG. 17, the right overlap flap 20 of the blanks 10 may be folded up when they enter this work station. This may be a result of the pre-braking of this flap that occurred at the work station illustrated in FIG. 15. In FIG. 17, an L-shaped bar 70 may be mounted on the machine frame 102 just past the location at which the cold air may be dispensed. The generally horizontal leg 71 of the L-shaped bar 70 may extend at an angle across the path of the upturned overlap flaps 20. As a result, the right overlap flaps 20 may be returned to the horizontal attitude. This may allow the blanks 10 to be received between another set of upper belts 52 and lower belts 53 which may take over the task of transporting the blanks along the length of the machine. This may be necessary because, at the next work station, the left glue flap 19 may be folded flat against the central section 18 of the blank 10 and then seam adhesive 23 may be applied to the surface of the left glue flap 19.

Figure 18:
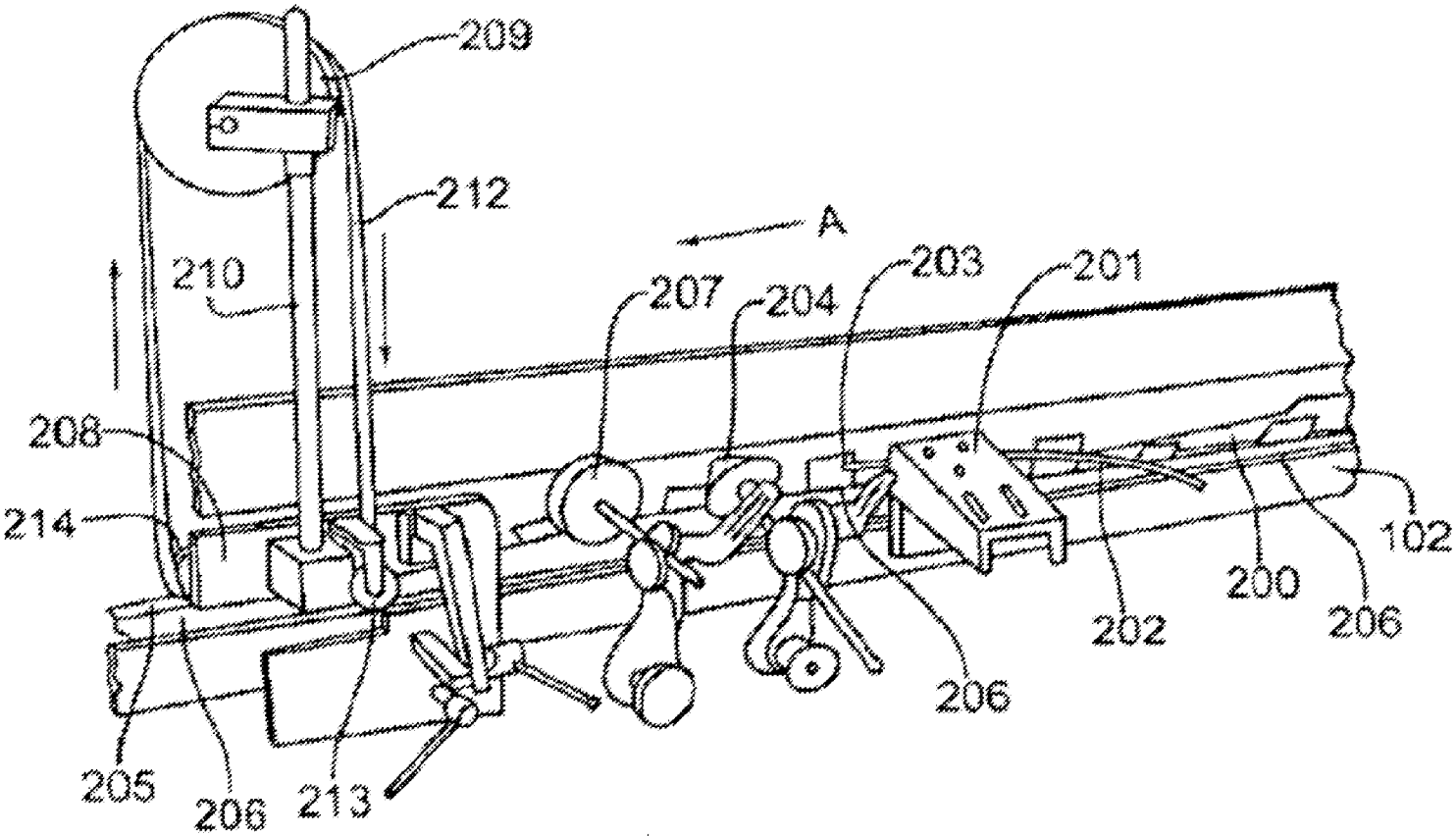
FIG. 18 is a perspective view of an exemplary work station at which the left glue flap is folded flat over the central section of the blank.

The next work station, illustrated in FIG. 18 of the machine 100, may be where the left glue flap 19 is folded flat over the central section 18 of the blank 10. In FIG. 18, the left glue flap 19 may be moving from right to left. As the left glue flap 19 enters this work station, they may be elevated a bit from the horizontal position. This may be a result of the pre-braking of this flap that may have occurred at the work station illustrated in FIG. 14. A folding sword 200 may be mounted on the machine frame 102 such that it overlies the blank 10 in the area of the perforated radial fold line 16. The folding sword 200 may function to hold down the central section 18 of the blank 10 and provide an edge along which the left glue flap 19 will be folded. A break bar 202, that may be mounted to the machine frame 102, may extend inward and over the tip of the folding sword 200 such that the leading edge of the folded up glue flap 19 may encounter the break bar 202. The break bar 202 may extend inwardly from the point where initial contact is made with the flap 19 to its free end 203. The leading edge and the bottom surface of the glue flap 19 may slide along the break bar 202 causing the glue flap to pivot further toward the horizontal position.

A carrier belt transition guide 201 may be secured to the machine frame 102. The carrier belt transition guide 201 may have three freely rotating, vertically orientated rollers through which the belt 206 is threaded. The location of belt 206 may be also seen in the preceding work station that is illustrated in FIG. 14. Thus, belt 206 may be twisted from a horizontal attitude to a vertical attitude. As a result, at the free end 203 of the break bar 202, belt 206 may be vertically oriented and may be functioning to orientate the glue flap 19 in a vertical orientation. The glue flap 19 may continue to advance to the left, in FIG. 18, to the position where the conical-shaped folding assist wheel 204 may be located. The folding assist wheel 204 may engage the upper or outer surface of belt 206 which, in turn, may engage the glue flaps 19 as they move past this location. The conical-shaped folding assist wheel 204 may cause the belt 206 to move from its vertical attitude to about a 45 degree angle and, in turn, may cause the glue flap 19 to assume this attitude. The belt 206 may next encounters the folding hold down wheel 207 that may engage the upper surface of belt 206 causing it to move to a horizontal attitude.

At this location, the glue flap 19 may be folded flat over the central section 18 of the blank 10. During the above discussed process, illustrated in FIG. 18, the lower surface of the central section of the blank 10 may have been supported by a bottom belt 205 which can be seen at the far left of FIG. 18. After the glue flap 19 leaves, the location of the folding hold down wheel 207, the flap may be retained in the flat folded down attitude by a hold down mechanism 208 that sandwiches the flap 19 between belt 206 and the bottom belt 205. The hold down mechanism 208 may provide positive control of the blank 10 after the left glue flap 19 may have been folded flat on the central section 18 of blank 10. Hold down mechanism 208 may include a first roller 214, an upper sheave 209 and a second roller 213. Upper sheave 209 may be mounted to freely rotate at the top of a mast 210. The belt 206 may extend under roller 214, up and around sheave 209 and then down and around roller 213. The belt 206 may be, at this point, horizontal and may be moving from right to left as indicated by arrow A.

Figure 19:
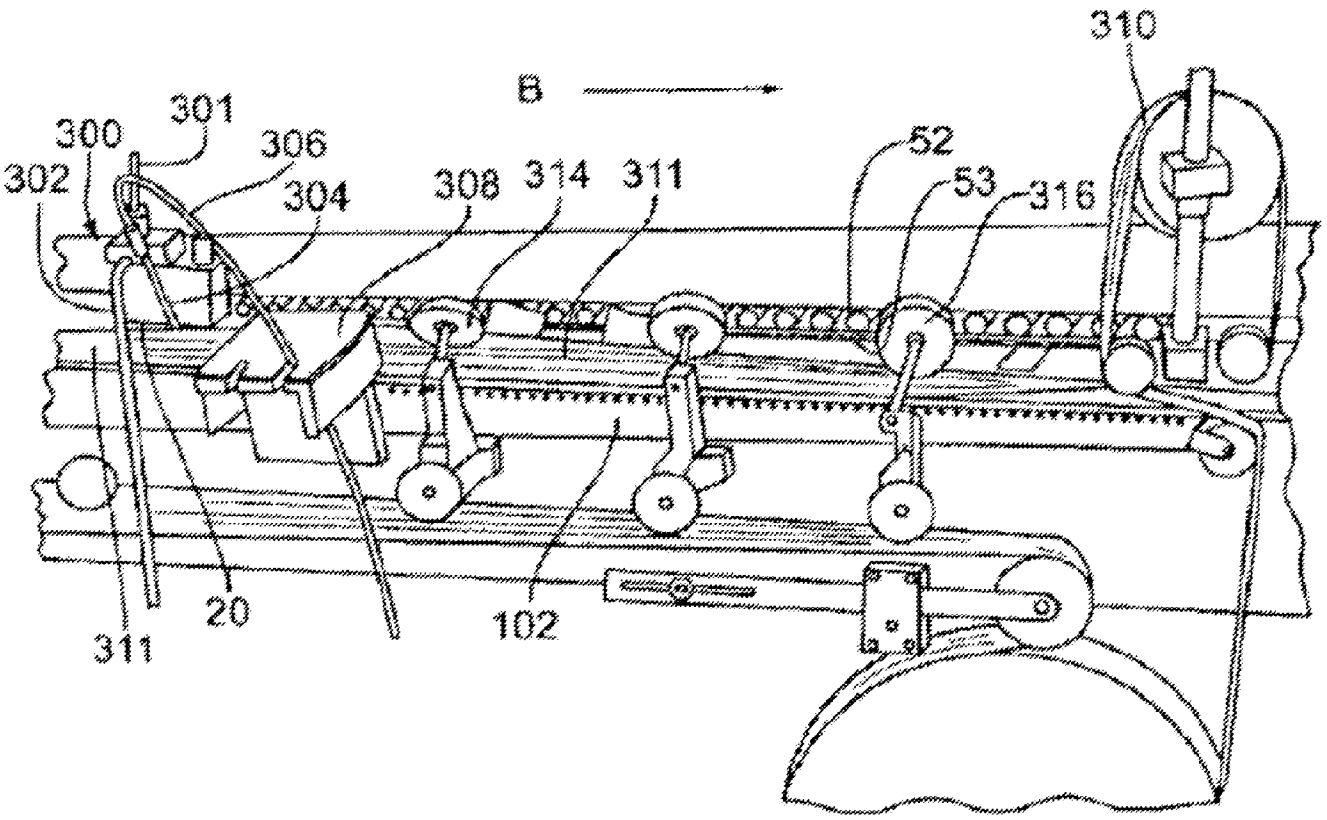
FIG. 19 is a perspective view of exemplary work stations at which the seam adhesive is applied and the right overlap flap is folded over and pressed against the area where the adhesive has been applied.
Figure 20:
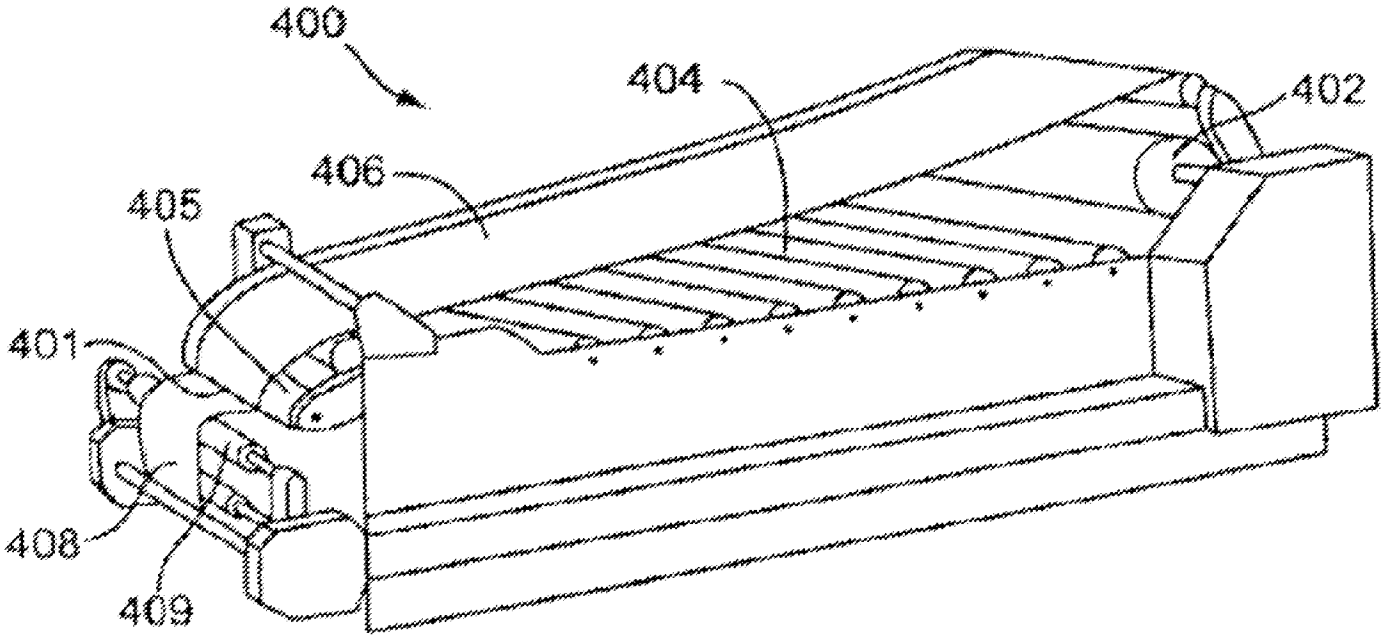
FIG. 20 is a perspective view of an exemplary pressure applicator.

In FIG. 19, the blanks 10 may be conveyed by an upper belt 52 and cooperating lower belt 53 from left to right. At this stage of the process, the left glue flap 19 may be exposed on the top of the blank 10. The next step in the process may be to apply the seam adhesive. The left glue flap 19 may be held in the folded over attitude by the upper 52 and lower 53 belts to allow adhesive to be applied. As seen in the left most portion of FIG. 19, the seam adhesive 23 may be applied to the linerboard surface of the folded over left glue flap 19. The adhesive dispenser 300 may be supported on the machine frame 102 by a support bar 301. The adhesive dispenser 300 may receive the adhesive through a flexible tube 302.

An electric eye 304 may sense the presence of a blank 10 and sends a signal to the machine processor through line 306 which, in turn, may send a signal back through line 306 to the dispenser 300 telling it when adhesive is to be dispensed. After the adhesive 23 has been deposited on left glue flap 19, the right overlap flap 20 may be folded over and pressed down against the area where the adhesive 23 was applied. A carrier belt transition guide 308 may be carried by the machine frame 102. The carrier belt transition guide 308 may have three freely rotating vertically orientated rollers through which the upper course 311 of a belt 310 is threaded. The belt transition guide 308 may function to twist belt 310 from a horizontal orientation to a vertical orientation as it moves there through. The right overlap flap 20 may be overlying the upper course 311 of horizontally orientated belt 310 as the blank 10 approached the area shown in FIG. 19.

As the upper course 311 of belt 310 begins to transition, prior to entering the belt transition guide 308, from a horizontal orientation to a vertical orientation the right overlap flap 20 may be pivoted upwardly about its perforated radial fold line 17. The upper course 311 may be at a vertical orientation as to exits the belt transition guide 308 and may have raised the right overlap flap 20 to the vertical attitude. As the blank 10 continues to move to the right, as seen in FIG. 19, it may reach a conical shaped folding assist wheel 314 that may engage the outer vertical surface of belt 310 causing the belt 310 to move back toward the horizontal attitude and fold the right overlap flap 20 toward the horizontal folded position. As the blank 10 continues to move to the right, as seen in FIG. 19, the belt 310 may encounter the folding hold down wheel 316 which may be a puck-shaped wheel that presses the overlap flap 20 down into the folded over horizontal attitude over the area where the adhesive may have been applied. At this point in the process, the blank 10 may have been formed into the finished product 500 with the exception of a final step of continuing to press the right overlap flap 20 into contact with the left glue flap 19 for a sufficient time to allow the adhesive to set.

As the product 500 continues to advance along the machine 100, it may reach the pressure application station of the machine 100. There may be a pressure applicator apparatus 400, FIG. 20, at this station. The pressure applicator apparatus 400 may include an upper continuous belt 406 and a lower continuous belt 408 that forms a receiving mouth 401. The products 500 may be fed by the upper belts 52 and lower belts 53 into the mouth 401 of the pressure applicator 400 and advance along the length of the pressure applicator 400. The upper belt 406 may extend over a large drive drum 402 located near the end of the machine, and below a series of freely rotating rollers 404 that may engage the internal surface of the lower rung of belt 406. The series of freely rotating rollers 404 may include an initial roller 405 that also engages the internal surface of the belt 406 along its forward edge. A lower belt 408 may extend over an initial roller 409 that may be followed by a series of adjustable rollers 409, all of which may engage the underside of belt 408. An adjustment mechanism may be provided for raising and lowering the series of rollers 409. By adjusting the lower belt 408 upward, the pressure exerted by the lower belt 408 on the finished product may be increased. Thus, if, for example, when the operator performs a quality test on the product, he finds that the adhesive holding the two flaps together is not adequately securing the ends together, he can then adjust the location of the set of lower rollers.

Figure 21:
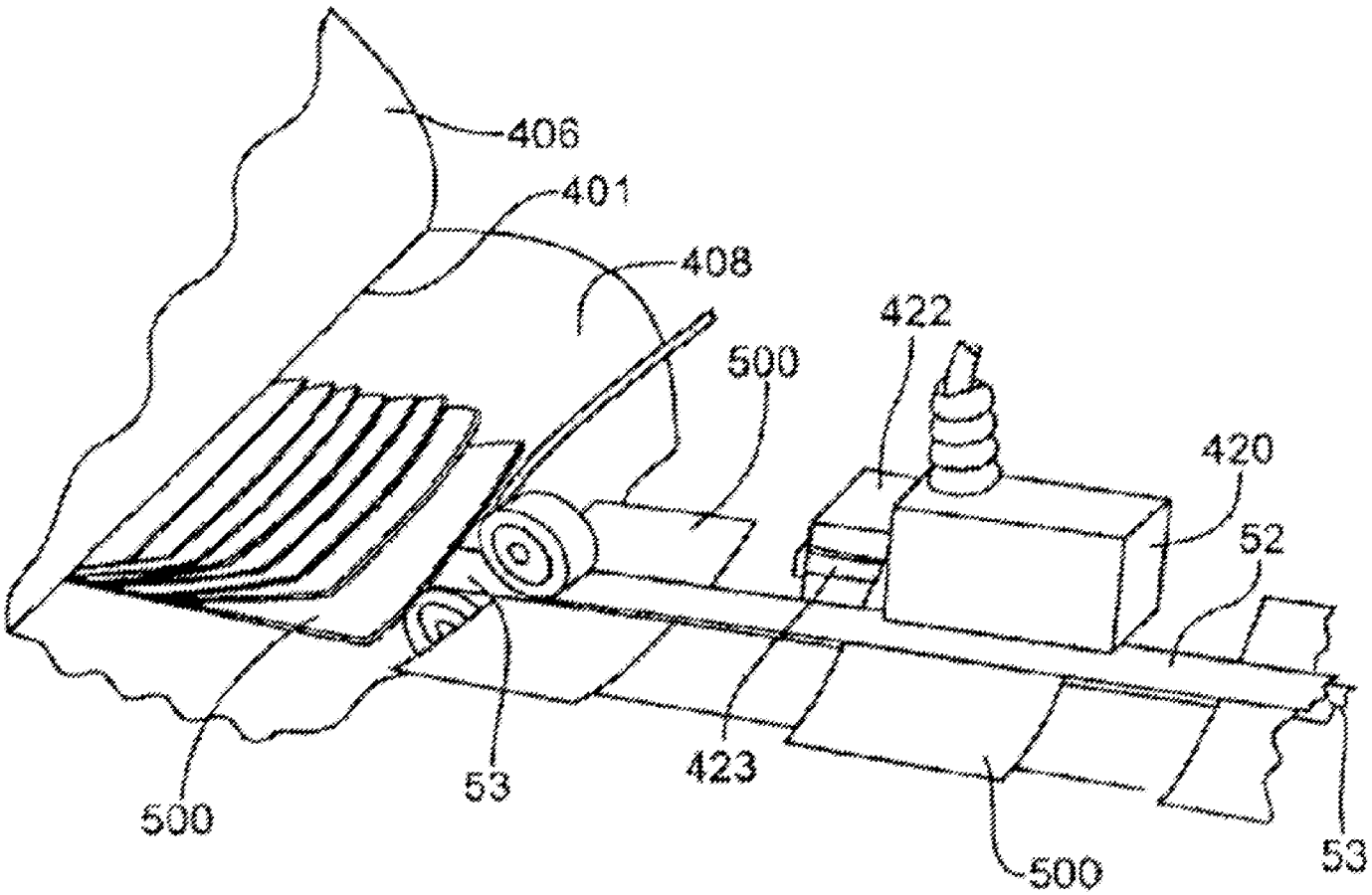
FIG. 21 is an enlarged perspective view of an exemplary finished product as it is being fed into the mouth of the pressure applicator.

FIG. 21 is an enlarged view of the products 500 being fed by an upper belt 52 and a lower belt 53 into the mouth 401 of the pressure applicator 400. It should be noted that belt 406 of the pressure applicator may be driven at a slower speed than the belts 52, 53 and, thus, the spacing between the blanks 10 that existed when the product was being propelled by belts 52, 53 may disappear once the products 500 enter the mouth 401 of the pressure applicator 400. The products thus may enter and egress from the pressure applicator 400 in an imbricated formation with the leading edge of the product 500 supporting the product that precedes it. An electric eye 420 may count the products 500 as they feed into the mouth 401 of the pressure applicator 400, sending a signal to the machine's operating system as each product 500 is recognized. There may be a mechanism 422, having an arm 423 pivoted thereto located slightly forward of the electric eye 420. The pivot axis of the arm may be such that, when it is pivoted, it will strike the last finished product that was counted by the electric eye 420 and displacing it from its usual orientation between belts 52 and 53. When the electric eye 420 has counted 134 products and sent these signals to the operating system, the operating system may send a signal to the mechanism 422 causing the arm 423 to pivot and displace a product 500 from its normal position in imbricated formation.

Figure 22:
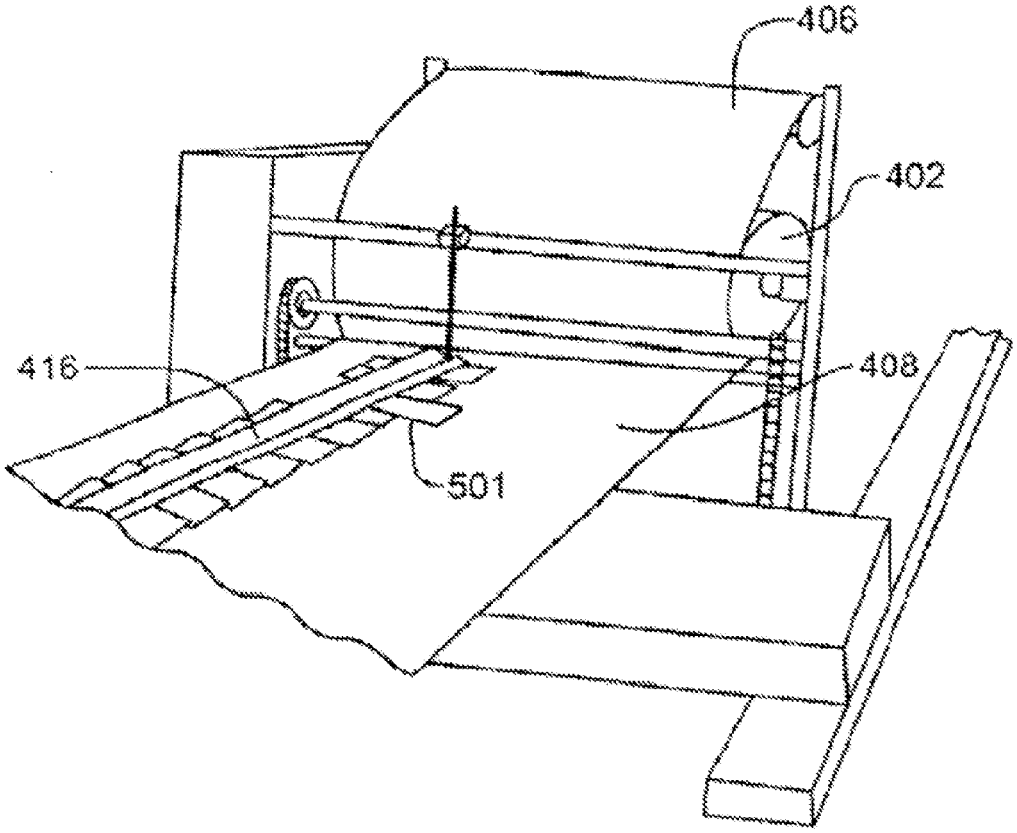
FIG. 22 is a perspective view from the back of the pressure applicator showing an exemplary finished product exiting the pressure applicator.

In FIG. 22, when the finished products 500 exit the pressure applicator 400, they may be in an imbricated formation with their leading front edge 11 under the trailing back edge of the preceding finished product 500. An elongated longitudinally extending metal bar 416 may rest along the center of the line of finished products. Metal bar 416 may be located at a point before the area where the finished products are picked up and placed in shipping cartons. An exemplary finished product 501 is shown in FIG. 22 that is not aligned with the other products 500. This may be a product that was a 125th product and was moved out of its normal position by the arm 423. The number 125 is arbitrary and could be other numbers, for example 100 or 500, that are based on parameters such as shipping carton size or customer requirements. An operator may uses the moved out finished product as a marker to pick up the next group of 125 finished products. Having the finished products arranged in an imbricated formation may greatly facilitate picking up a row of 125 products by grasping the first and the 125th products, compressing them such that they assume a vertical attitude, and each finished product 500 may lie flat against the adjacent finished products. With the finished products 500 having been compressed into a stack of finished products, the stack may be then placed into a shipping carton.

One possible process for forming a beverage container holder from a blank 10 after it is fed out of the feeder system will now be discussed with reference to FIGS. 23 and 24. It should be noted that in FIGS. 23 and 24, the blanks 10 are shown isolated from the machine 100 and its component parts are not shown in an effort to more clearly illustrate the beverage container holder manufacturing process. The blank, as fed from the feeder system and in the exemplary production process, as well as in the finished product form, are all seen in plan or top view in FIGS. 23 and 24. Further, a single blank will start in FIG. 23A and progress step-by-step until the final manufacturing step shown in FIG. 24D. Thus, the exemplary manufacturing process progresses step-by-step downwardly from the tops of the drawing sheets.

In FIG. 23A, the blank 10 is shown as it may appear when supported on the introductory belt 50 after it has exited the feeder system with the linerboard side down and the corrugated or fluted side up. As seen in this series of figures, the concave edge 11 of the blank 10 may be the leading edge and the convex edge 12 may be the trailing edge. The side edges 13 and 14 extend in a generally radial direction if the edges 11 and 12 are considered to be arches of concentric circles. The corner at the intersection of concave edge 11 and side edge 14 may have been trimmed off at 15 for a purpose to be discussed. In FIG. 23A, two perforated radially folding lines 16 and 17 may divide the blank 10 into a central section 18, a left glue flap 19 and a right overlap flap 20. As the blank 10 is fed through the machine 100, the blank 10 may be supported on its central section 18, and the flaps 19 and 20 may protrude outwardly therefrom in cantilevered fashion.

In FIG. 23B, the blank 10 is shown after being fed from the introductory belt 50 into the mouth 110 of the machine 100. A pre-breaking or pre-folding operation may next performed on both free ends of each blank. In these operations, the left glue flap 19, as well as the right overlap flap 20, may be folded up along the perforated radial fold lines 16 and 17, respectively. This pre-breaking or pre-folding operation may function to assure the proper operation of later steps in the process in which the flaps are completely folded over to a horizontal attitude.

The blank 10, as seen in FIG. 23C, may be at the location where adhesive 22 is applied to the corrugated surface of the blank 10. Two beads of adhesive 22 may be applied to the surface that will become the inside surface of the beverage container holder. One of the beads 22 may be applied to the central section 18 of the blank 10 and the other bead 22 may be applied to the left glue flap 19. When a coffee purveyor fills a container with hot coffee, this adhesive 22 may soften and function to resist the beverage container holder from slipping down or off the container. The adhesive may be applied from a glue head that is pointing down from a holder mechanism 60 that may be supported on the frame 102 of the machine 100, such that the adhesive beads 22 extend across a number of flutes at a slight angle extending from the leading edge 11 to the trailing edge 12. The two beads of adhesive 22 need not be applied simultaneously but both may be performed prior to the next step of chilling the adhesive.

One of the difficult problems that may be overcome in this exemplary manufacturing process is to prevent the adhesive that has been applied to an inside portion of the beverage container holder from sticking to the other panel of the blank when the blank is folded over and then compressed. This phenomenon may be called "blocking." If the adhesive tacks the inside panels together, then the beverage container holder may not open and cannot be placed on a cup.

After the adhesive has been applied to the fluted surface of the blank 10, the blank may proceed to its location shown in FIG. 230. At this location, the machine frame 102 may support a cold air dispensing mechanism 63 for each of the beads of adhesive 22 that was applied to the blank. The cold air dispensing mechanisms 63 may direct streams of freezing air on the beads of adhesive 22. This step may crystallize the adhesive sufficiently that it loses its ability to adhere or tack to the other side of the blank and, thus, prevents "blocking."

After the adhesive has been crystallized, the blank may move into the folding sections of the machine 100. In FIG. 24A, hold down mechanism 208 and its cooperating components may have caused the left panel, called the glue flap 19, to fold over onto the fluted section of the blank 10. In the exemplary manufacturing process of the blank 10, prior to placing the stack of blanks into the vertical containment apparatus 30, a perforated radial fold line or score 16 may have been formed in the blank which defines this fold line of the blank 10.

In FIG. 24B, the seam adhesive 23 may have been applied to the area 21 of linerboard surface. At this station of the machine 100, there may be an adhesive dispenser 300 that dispenses adhesive 23 to an area 21 of the left glue flap 19.

In FIG. 24C, folding hold down wheel 316 and its cooperating components may have guided the right panel, called the overlap flap 20, such that it may have been folded along the perforated radial fold line 17 such that its free end may overlie area 21 of the glue flap 19 where the seam adhesive 23 was deposited.

In FIG. 24D, pressure may be applied by the pressure applicator 400 to the overlapped area of the overlap flap 20 and glue flap 19 which may result in securing the free ends of the blanks 10 to each other. At this location of the machine 100, there may be a pressure applicator 400 in the form of a belt 406 that is driven by a large driven drum 402 and extends over a freely rotating roller bar. Pressure may be applied at this station and the product may now be completed and ready to be packaged for shipment.

The exemplary process for producing the finished product may have been completed. Since the finished product may be flat, it can be conveniently packaged in containers and shipped to the locations of the beverage purveyors. When the final products are opened they may have the shape of frustum of a cone that coincides with the conical frustum of the beverage containers.

The method and machine described above is merely one example of a process that can occur with blanks after they have been separated from sheets. The feeder system described above may be used in conjunction with any process involving blanks separated from sheets.

While various examples have been described, it will be apparent to those of ordinary skill in the art that many more examples and implementations are possible within the scope of the invention. Accordingly, the invention is not to be restricted except in light of the attached claims and their equivalents.

We claim:

1. A system for separating an individual blank from a plurality of conjoined blanks that form a sheet of blanks and feeding the separated individual blank to a machine for assembling a beverage container holder, comprising:

a sheet of blanks having a width between laterally opposite sides thereof and including a leading first blank and at least a trailing second blank attached separably to the first blank at a trailing end thereof;

a sheet holder configured to hold a plurality of the sheets of conjoined blanks stacked therein and successively release a single and lowermost sheet from said stack of sheets;

a holder conveyor configured to receive said lowermost sheet released from the sheet holder and transport the received lowermost sheet towards a separating conveyor;

a resistance mechanism that exerts a force upon the lowermost sheet during transport towards the separating conveyor, said force configured to maintain the sheet in contact with the holder conveyor during transport;

a separating conveyor disposed adjacent said holder conveyor and configured to receive the first blank of the lowermost sheet as said holder conveyor transports said lowermost sheet towards said separating conveyor, said separating conveyor configured to apply a substantially uniform pulling force across the width of the first blank to separate the first blank from the second blank; and wherein the separating conveyor conveys the separated first blank towards the machine for assembling the beverage container holder.

2. The system of claim 1, wherein the separating conveyor includes laterally outer longitudinally extending conveyor edges with a width therebetween that is substantially similar to the width of the sheet of blanks such that the separating conveyor applies the substantially uniform pulling force across the width of the first blank.

3. The system of claim 1, wherein the separating conveyor includes laterally outer longitudinally extending conveyor edges and a pair of opposing sidewalls that are laterally beyond the laterally outer conveyor edges, the pair of opposing sidewalls forming an outer lateral boundary of the separating conveyor such that the laterally opposite sides of the separated individual blank pass between the opposing sidewalls and do not extend laterally beyond the outer lateral boundary of the separating conveyor when the blank is conveyed through the separating conveyor.

4. The system of claim 1, wherein the separating conveyor includes a plurality of conveyor belts including at least a centrally located conveyor belt and opposing laterally outer conveyor belts spaced from the centrally located conveyor belt on either side thereof, the plurality of conveyor belts configured to apply a substantially uniform pulling force across the width of the first blank to separate the first blank from the second blank.

5. The system of claim 1, wherein the first and second blanks are connected at a preformed perforated line that extends across the width thereof and the substantially uniform pulling force is configured to separate the first blank from the second blank along the perforated line.

6. The system of claim 1, wherein the holder conveyor is configured to transport the sheet of blanks at a first speed, and the separating conveyor is configured to convey the separated first blank at a second speed which is faster than the first speed.

7. The system of claim 1, wherein the resistance mechanism includes a pair of spaced rollers that are disposed above the holder conveyor such that when the first blank is received by the separator conveyor, the second trailing blank is under the pair of spaced rollers.

8. The system of claim 1, wherein the separator conveyor includes top and bottom conveyor mechanisms, wherein said top conveyor mechanism and said bottom conveyor mechanism each include a plurality of laterally spaced apart separating belts configured to travel at the same speed so that the leading first blank is pulled by each of the laterally spaced apart separating belts across the width of said first blank to separate the first blank from the trailing second blank.

9. The system of claim 8, wherein the top conveyor mechanism and said bottom conveyor mechanism each include five laterally spaced apart conveyor belts.

10. The system of claim 1, wherein the portion of the machine for assembling the beverage container holder that receives the separated blanks from the separating conveyor includes a blank conveyor having laterally outer longitudinally extending conveyor edges with a width therebetween that is less than the width of the sheet of blanks and engages the separated blanks near a center thereof so that the opposite lateral ends of the blanks extend outwardly in a cantilever fashion from longitudinal conveyor edges of the blank conveyor.

11. A method for separating an individual blank from a plurality of conjoined blanks that form a sheet of blanks and feeding the separated individual blank to a machine for assembling a beverage container holder, comprising:

loading a plurality of sheets of conjoined blanks into a sheet holder, wherein each sheet of conjoined blanks has a width between laterally opposite sides thereof and including a leading first blank and at least a trailing second blank attached separably to the first blank at a trailing end thereof;

releasing a single and lowermost sheet from the sheet holder onto a conveyor;

conveying the lowermost sheet released from the sheet holder toward a separating conveyor;

separating the leading first blank from the trailing second blank with the separating conveyor, including:

receiving the first blank of the lowermost sheet in the separating conveyor;

applying a substantially uniform pulling force across the width of the first blank with the separating conveyor;

inducing a resistive force on the trailing second blank while applying the substantially uniform pulling force to separate the first blank from the second blank; and conveying the separated first blank to a machine for forming a beverage container holder.

12. The method of claim 11, wherein each sheet of conjoined blanks includes at least 4 blanks including the leading first blank and the trailing second blank.

13. The method of claim 11, wherein the lowermost sheet comprises a third blank attached separably to the second blank at a trailing end thereof, the method further comprising:

receiving the second blank of the lowermost sheet in the separating conveyor;

applying a substantially uniform pulling force across the width of the second blank with the separating conveyor;

inducing a resistive force on the trailing third blank while applying the substantially uniform pulling force to separate the second blank from the third blank; and conveying the separated second blank to a machine for forming a beverage container holder.

14. The method of claim 13, wherein conveying the lowermost sheet released from the sheet holder is done at a first speed, and conveying the separated first and second blanks is done at a second speed faster than the first speed to create a spacing between the separated first and second blanks.

* * * * *